US005270475A

United States Patent [19]

Weiss et al.

[11] Patent Number: 5,270,475

[45] Date of Patent: Dec. 14, 1993

[54] ELECTRONIC MUSIC SYSTEM

[75] Inventors: Nathaniel Weiss, Merion Station; Jonathan Grayson, Philadelphia, both of Pa.; Jonathan Coopersmith, Princeton Junction, N.J.

[73] Assignee: Lyrrus, Inc., Philadelphia, Pa.

[21] Appl. No.: 664,208

[22] Filed: Mar. 4, 1991

[51] Int. Cl.[5] ..... G10H 3/12

[52] U.S. Cl. ..... 84/603; 84/645; 84/646; 84/616; 84/654; 84/454; 84/DIG. 18

[58] Field of Search ..... 84/603, 645, 646, 454, 84/615-618, 653-655, DIG. 18

[56] References Cited

U.S. PATENT DOCUMENTS

| | | | |
|---|---|---|---|
| Re. 33,739 | 11/1991 | Takashima et al. | 84/603 |
| 4,690,026 | 9/1987 | McCoy | 84/603 |
| 4,702,141 | 10/1987 | Bonanno | 84/DIG. 30 |
| 4,970,935 | 11/1990 | Morikawa et al. | 84/603 |
| 5,018,427 | 5/1991 | Uchiyama | 84/603 |
| 5,024,134 | 6/1991 | Uchiyama | 84/654 |
| 5,033,353 | 7/1991 | Fala et al. | 84/723 |

*Primary Examiner*—William M. Shoop, Jr.
*Assistant Examiner*—Brian Sircus
*Attorney, Agent, or Firm*—Reed Smith Shaw & McClay

[57] ABSTRACT

An electronic music system for computer-controlled interactive practicing and learning to play a guitar includes a transducer which is detachably securable to the guitar and generates analog signals representing the playing of the guitar, an interface for converting the analog signals to computer-processable digital signals, and a computer for receiving and processing the digital signals. The system uses a communication protocol which employs time stamping of data to permit use with ordinary guitars but without high speed frequency determination. The computer provides audio and video outputs including staff and guitar fingering representations of notes, chords, scales, compositions, and like musical structures, both to teach the user and suggest music to be played by the user and to illustrate what the user has played. The system is operable in several modes which may be controlled by the user by signals produced at the transducer.

41 Claims, 11 Drawing Sheets

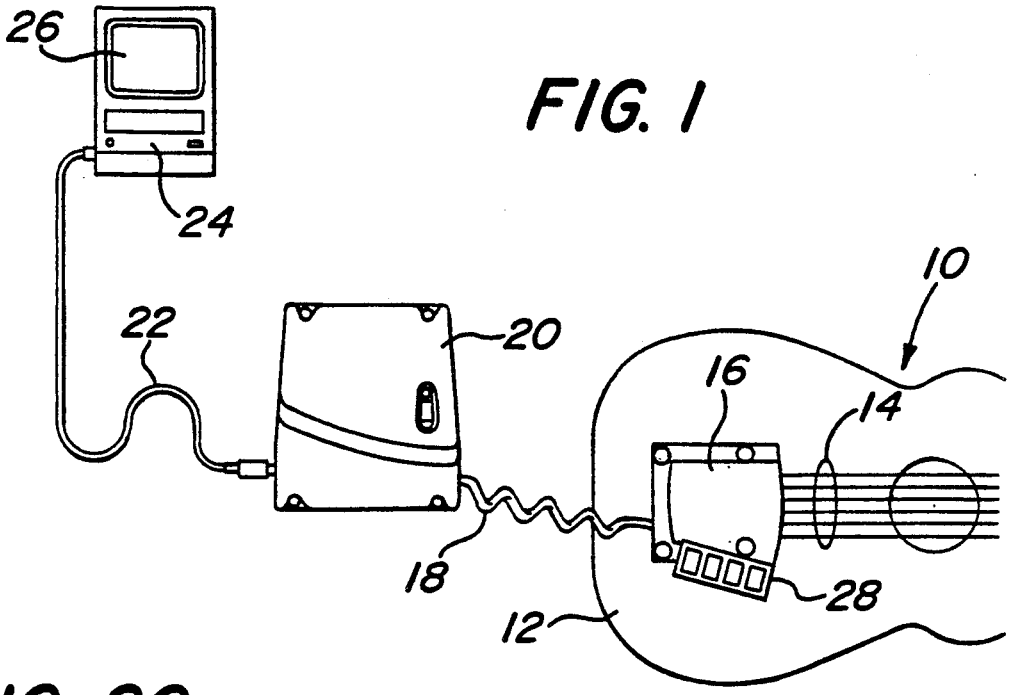
FIG. 1
FIG. 20
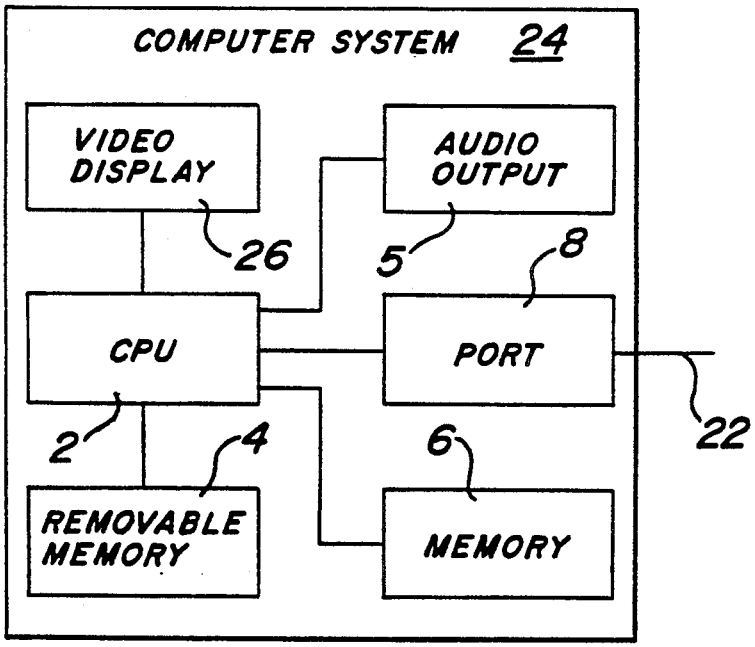
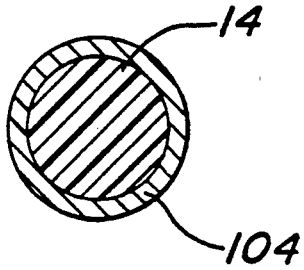
FIG. 6

FIG. 2
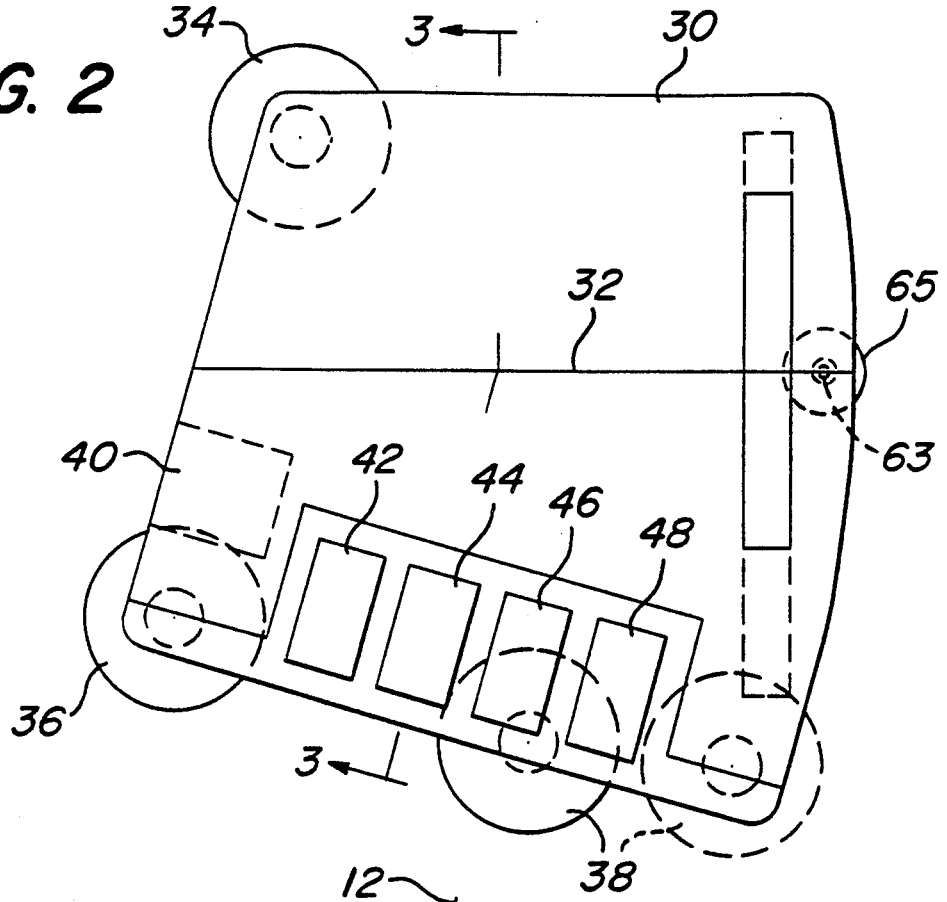
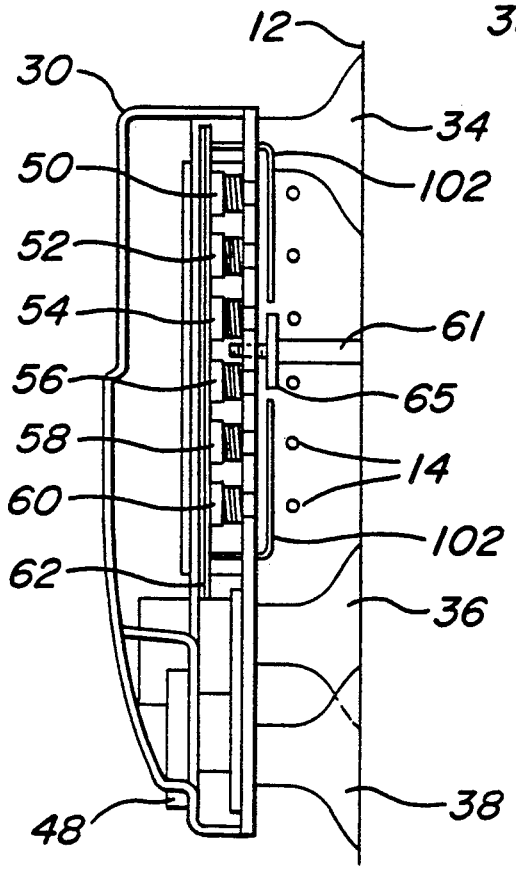
FIG. 3

ELECTRONIC MUSIC SYSTEM

FIELD OF THE INVENTION

This invention relates to electronic music systems. More particularly, this invention relates to music systems in which an electronic signal is generated in response to the playing of a stringed instrument, such as a guitar. This invention also relates to a computer-based interactive music system which may be used as an aid in practicing or learning how to play a musical instrument such as a guitar.

BACKGROUND OF THE INVENTION

Electronic music systems employing a computer which receives and processes musical information are known. However, known systems suffer from a number of drawbacks which render them unsuitable for general use in certain interactive applications such as learning applications.

For example, certain systems such as keyboard systems may use key actuated switch closures to generate signals representing musical information. In such systems, the input device is not in fact a traditional musical instrument but is a keyboard which directly provides computer-usable data outputs and simulates a keyboard instrument.

Various approaches have been used to create electronic music systems in which the input device is not a traditional keyboard, but is a device simulating a musical instrument. For instance, various guitar-like devices have been made which utilize contacts actuated by playing the instrument in order to generate signals representing such playing. Such devices are not truly musical instruments, but merely are dedicated computer input devices which function similar to but are shaped differently than an ordinary keyboard.

Various other attempts have been made to mate a guitar-like musical input device with a computer system. For instance, special-purpose guitars have been constructed in order to provide a computer input more nearly corresponding to the output of a guitar. For example, guitars have been constructed using strings all of the same gauge which are tuned to high frequencies; this provides ease of detection of string and fret data, but precludes playing without the computer. Such guitars have been typically designed to communicate with a computer via a MIDI interface (Musical Instrument Digital Interface). Such special purpose guitars have not been well received, in part because construction features necessary for prior art methods of signal acquisition render these guitars substantially different from ordinary guitars, and guitarists may be unwilling to purchase an additional guitar solely for the purpose of providing an input to a computer system. Moreover, the MIDI interface is not well suited to use with real guitars, because it is based on real time signal processing, and real time conversion of guitar notes to MIDI data is difficult and expensive.

The MIDI interface is designed to enable the coupling and coordination of a large number of instruments and computers. The MIDI protocol is an effort to provide a standard interface between instruments and computers, so that any MIDI instrument can be coupled to any MIDI computer. However, the MIDI protocol includes certain features which render it extremely difficult to make a converter which provides a MIDI output from a real guitar, and any modification of the protocol to facilitate the interchange of data between a guitar and a computer would remove the protocol from standard MIDI.

In particular, MIDI devices are synchronized by a common system timing clock, such as a sequencer or a drum machine. MIDI messages include "Note On", which when transmitted includes the key number or other frequency information for the note being played. Thus, frequency information must be available when a MIDI "Note On" message is to be transmitted, which may be an extremely short time after the note is played. This poses no problem for typical MIDI instruments such as keyboards, in which frequency information is inherent in the key which is struck. However, for real instruments such as guitars the only way to quickly provide frequency information is with high speed converters, which are complex and expensive. Simpler, low cost techniques such as timing the period of the note played take too long to provide MIDI data when a note, particularly a low note, is struck.

Moreover, MIDI systems are typically essentially synthesizers where the instrument being played is merely a controller and the sound which is created is synthesized by a computer.

SUMMARY OF THE INVENTION

It is therefore an object of the invention to provide a computer based music system which is suitable for use with a variety of traditional musical instruments, particularly string instruments, and more particularly guitars.

It is another object of the invention to provide such a music system which is easily adapted to use with a wide variety of commercially available guitars.

It is another object of the invention to provide a string instrument transducer system which may be used with instruments having any type of strings to generate electronic signals representing the movement of such strings.

It is another object of the invention to provide a string instrument transducer system which may be detachably secured to a string instrument without marring, defacing, or modifying the instrument.

It is another object of the invention to provide an interface between a string instrument transducer and a computer, which provides computer-processable output signals in response to transducer output signals.

It is a further object of the invention to provide such an interface which is simple, reliable, and inexpensive.

It is another object of the invention to provide a music system having a computer system for receiving inputs responsive to the playing of a musical instrument and producing outputs for assisting a musician in learning to play and/or practicing on an instrument.

It is another object of the invention to provide such a music system which is interactive with the musician.

It is another object of the invention to provide such a music system in which the operation of the computer system may be controlled from the musical instrument.

In accordance with the foregoing objects, the music system of the preferred present invention includes three primary subsystems: a transducer system adapted to be easily and detachably coupled to any standard guitar, which provides electronic output signals responsive to the playing of the guitar; an interface system for receiving transducer output signals and processing them to produce computer-usable output signals responsive to the playing of the guitar; and a computer system for receiving signals from the interface system and for generating audio and/or video outputs suitable for assisting a musician in practicing or learning to play the guitar. Although these subsystems are physically separate and coupled by communication channels in the preferred embodiment described herein, they may also be combined.

Further in accordance with the invention, a novel protocol is provided for interchanging data between the interface system and the computer system. In accordance with this protocol, data is transmitted from the interface system to the computer system to indicate that a string has been struck as soon as such an event occurs. However, other information such as frequency information is not transmitted at that time; rather, the event data is associated with identifying data such as by time-stamping, i.e. data representing the time of an event is transmitted with data representing the nature of the event. When other data such as frequency information later becomes available, it is then transmitted, together with identifying data such as time stamp data identifying the event to which the further data relates. Thus, the computer system may associate data received at different times regarding a single event.

In the preferred embodiment, operation of the computer system may be controlled in response to control signals generated at the transducer.

Other objects and features of the invention will become apparent upon review of the following specification and the drawings.

BRIEF DESCRIPTION OF THE DRAWINGS

FIG. 1 is a schematic representation of the primary elements of the music system of the present invention.

FIG. 2 is an illustration of a transducer assembly in accordance with the present invention.

FIG. 3 is a side view of the transducer assembly shown in FIG. 2.

FIG. 6 illustrates a method and apparatus for rendering nylon or other non-ferromagnetic strings suitable for use with the transducer of the present invention.

FIG. 20 is a block diagram illustrating generally the principal components of a computer system.

DETAILED DESCRIPTION OF THE PREFERRED EMBODIMENTS

Figure 4:
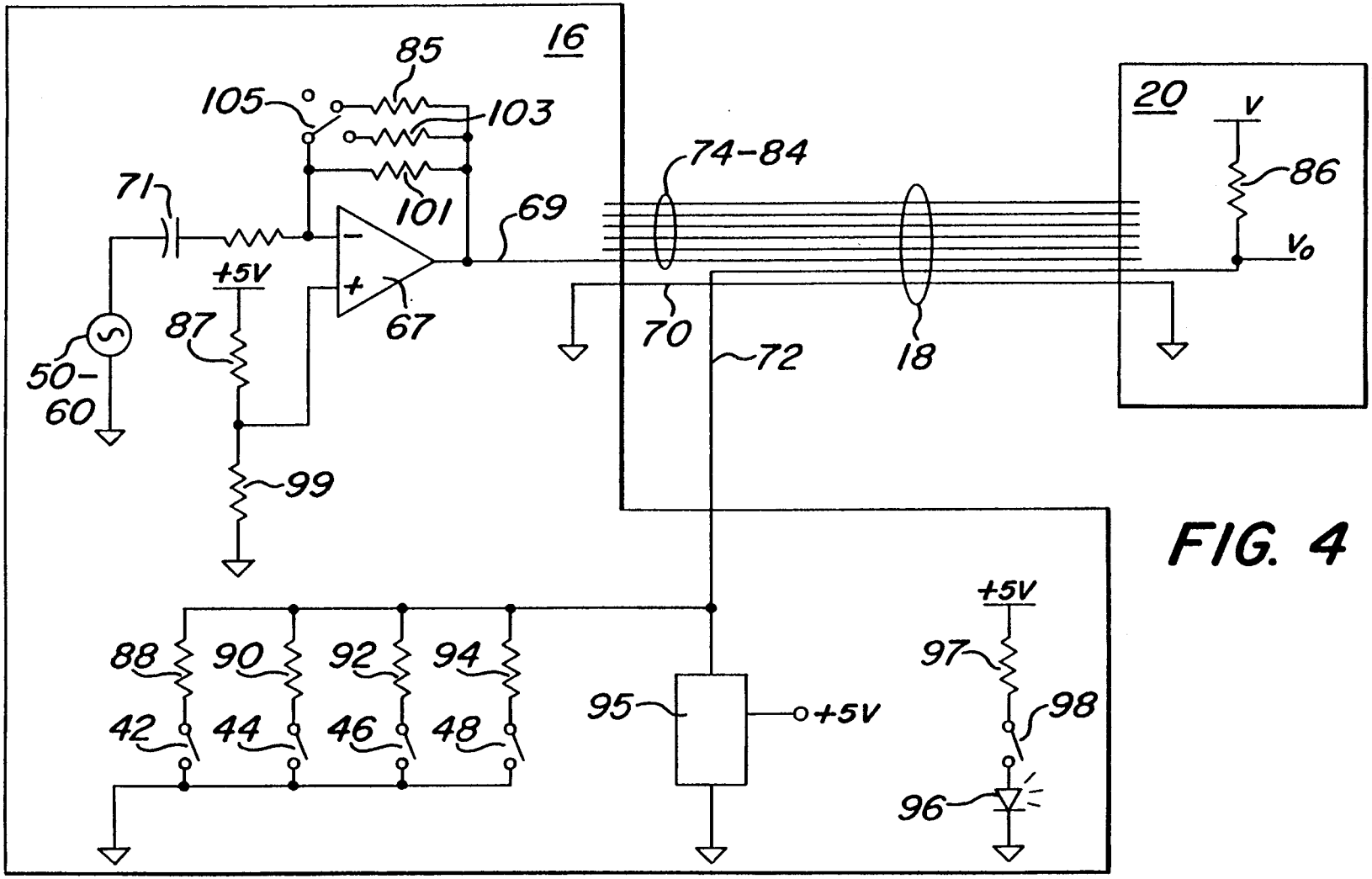
FIG. 4 is an electrical schematic diagram of the transducer assembly and of certain parts of the interface system.

FIG. 1 illustrates schematically the general features of the electronic music system of the present invention. The system includes a guitar 10, partially shown, including a body 12 and strings 14 which are secured to body 12. Although a guitar is shown and is expected to be the primary instrument used with the present invention, it will be understood that the invention may be used with other string instruments, particularly instruments having frets, or other types of instruments. A transducer system or assembly 16 is mounted to guitar body 12 and provides electrical outputs responsive to the vibrations of the guitar strings 14. Desirably, transducer assembly 16 is adapted to be used with any type of commercially available guitar 10. Also, transducer assembly 16 is desirably constructed so as to be easily and quickly mounted to a guitar without any modification to the guitar when use of a computer system is desired, and easily and quickly detached from the guitar to return it to its original state. Although it is preferred that transducer assembly 16 is detachably securable to an instrument, it will be understood that in certain circumstances a manufacturer or musician will desire to more permanently secure such a transducer to an instrument, and the other aspects of this invention are fully applicable to such instruments. Analog electrical signals generated by transducer 16 are coupled to interface system 20 by communication channel 18. Desirably, communication channel 18 comprises a standard cable assembly such as a multi-conductor telephone cable assembly.

Interface system 20 comprises circuitry for receiving output signals from transducer 16 and generating responsive digital signals in a predetermined data format suitable for input to a computer.

The system of the invention further includes a computer system 24, shown in more detail in the block diagram of FIG. 20, including a central processing unit or CPU 2, memory preferably including removable non-volatile memory 4 such as a magnetic disk, input/output devices and ports, and similar components of a standard computer system. The preferred computer system 24 is an Apple Macintosh computer system, because of its wide commercial availability and good graphics and audio capabilities, but other commercially available devices such as PC-type computers or the Nintendo TM entertainment system may also be used. Computer 24 comprises a video display output 26 such as a CRT and an audio output 5 such as a speaker for output of information to the user. Computer system 24 includes a port 8 through which CPU 2 is coupled to interface system 20 by a communication channel 22 for transmitting data between the interface system and the computer system. Communication channel 22 may desirably be a standard data communication channel such as a serial channel employing an RS-232 cable coupled to RS-232 ports on computer system 24 and interface system 20. The MIDI interface, in contrast, requires a special MIDI port not generally provided in computer systems.

Computer system 24 receives data representing the playing of the guitar from communication channel 22, and is programmed to operate on such data to provide an interactive teaching or practicing system. Computer system may generate audio and/or video outputs for such teaching or practicing, such as outputs representing a note, scale, chord, or composition to be played by the user, and outputs representing what was actually played by the user. Computer system 24 may be operable in a variety of modes to assist the user in setting up the system and practicing or learning music, and may generate outputs informing the user of the current mode of operation and changes thereto which may be effected by the user.

As shown in FIG. 1, the transducer assembly 16 is coupled to computer system 24 by flexible cables, to permit the musician to move while playing the guitar. Interface system 20 may be adapted to be worn by the musician such as by being clipped on the musician's belt, or it may be placed near computer system 24, as desired. It will be understood that interface system 20 is preferably provided as a separate physical unit, and this is because of the weight and bulk which a unit attached to the guitar would require if the functions of the interface system were incorporated into such a unit, but incorporating the transducer and interface functions in a single unit may be feasible.

Also as shown in FIG. 1, transducer assembly 16 includes switches 28. These switches provide means for generating transducer output signals to communication channel 18 which may be used to control the program flow and operation of computer system 24. To this end, interface system 20 transmits data corresponding to such transducer output signals to computer 24 over communication channel 22 upon receipt of such signals. This permits the user to control program flow from the location of the guitar, eliminating the need for the user to go to a keyboard or a mouse to do so. Desirably, the functions effected by actuating switches 28 are varied under program control by computer 24 so that a few switches may perform a wide variety of functions which may be varied depending on context. To this end, computer 24 desirably outputs video display information indicating what function will be effected by actuation of the switches at the time.

Because the music generating instrument of the present invention is a real instrument such as a guitar, the musician receives acoustic feedback to hear what he is playing directly from the guitar. Since most MIDI instruments are synthesizer controllers, no direct acoustic feedback is available and such feedback must be synthesized by the computer.

FIGS. 2 and 3 show a transducer assembly 16 in accordance with the preferred embodiment of the present invention. FIG. 2 is an illustration of transducer assembly 16, in the same orientation as shown in FIG. 1, and FIG. 3 is a side view of the transducer assembly of FIG. 2 including a partial cross section taken along the lines 3—3 in FIG. 2. Transducer 16 comprises a housing 30 to which the remaining components are directly or indirectly mounted. Housing 30 may be a molded plastic shell or the like. Mounted within housing 30 are a plurality of ferromagnetic coils 50–60 functioning as transducers or pickups, although other means producing an analog electrical output signal responsive to string movement may be used as transducers. One coil is provided for each string of the musical instrument; for a six-string guitar having six strings 14, six ferromagnetic coils 50–60 are provided. Such coils may be standard pickups of the sort typically used with electric guitars. The coils 50–60 are spaced from one another at about the standard spacing of guitar strings so that one coil will be positioned adjacent each string when the transducer assembly 16 is mounted to a guitar 10. Although the standard guitar string spacing varies depending on the type of guitar, it has been found that a single spacing at the mean of the minimum and maximum traditional spacings will position the ferromagnetic coils sufficiently accurately to enable detection with any such guitar string spacing. Standard guitar string spacing (E—E) ranges from 2.03 inches to 2.25 inches, or about 0.41 to about 0.45 inches between adjacent strings. By spacing the ferromagnetic coils at about the mean spacing of 0.43 inches, or preferably in the range of about 0.42 to about 0.44 inches, adequate coil output for use in the present invention may be obtained over the entire range of standard guitar string spacings. This is one aspect which permits the transducer of the present invention to be applied to a wide variety of guitars.

For ease of connection and mounting, coils 50–60 are desirably and as shown mounted in fixed positions, in a generally linear orientation, at a substantially uniform spacing along such a line of orientation. It will be understood that the coils may also be mounted by means permitting mechanical adjustment of the coil spacing, to permit the spacing to be adjusted to correspond to the string spacing of a particular guitar, although this is not believed generally to be necessary. It will also be understood that the coils may not be oriented in a line perpendicular to the strings; for instance, with coils having diameters larger than the string spacing, it may be necessary to mount the coils in a staggered fashion or in a line which is not perpendicular to the strings. What is important is the spacing along a line of orientation perpendicular to the strings, and this spacing is desirably uniform in the ranges stated above.

Ferromagnetic coils 50–60 are desirable mounted to printed circuit board 62 so as to facilitate connection of the coils to other circuitry. The coils are desirably electrically arranged so that one conductor is common to all coils, and one line is dedicated to the output of each coil.

Transducer assembly 16 includes means for detachably securing the transducer assembly to guitar 10 so that the ferromagnetic coils are spaced adjacent the strings of the instrument, preferably in the region of the bridge of the instrument. Such a mounting means desirably does not require any marring, defacing, or modification to the guitar in order to mount the transducer assembly 16. The preferred embodiment of such mounting means, as shown in FIGS. 2 and 3, includes a plurality of suction cups 34, 36, and 38 which are mounted to the transducer assembly and adapted to be detachably secured by suction to the surface of guitar body 12. It has been determined that by making the position of one of such suction cups 38 adjustable, between the positions as shown, the transducer assembly may be secured to a wide variety of commercially available guitars without interfering with the strings or other portions of such guitars. It is highly desirable that the transducer be mounted to the guitar in a way which does not require any permanent modification, such as drilling of holes in the guitar. Suction cups are preferred, but other means for such mounting may be employed, such as a belt or strap attached to the transducer and adapted to be placed around the guitar body, or mounting in the same manner as the guitar strings are attached to the guitar body.

In order to ensure that an optimum signal is obtained by ferromagnetic coils 50–60, the coils should be placed as close as possible to the strings 14 without interfering with their movement. However, the height of strings 14 above guitar body 12 varies from guitar to guitar. Accordingly, the transducer assembly 16 of the present invention includes means for adjusting the height of the coils 50–60 so that the coil-string spacing may be optimized. The preferred means for adjusting the coil-string spacing comprises an adjustable length post 64 mounted to transducer assembly 20 adjacent the coils. Post 64 may include a pair of cooperatively engaged threaded members, and as shown includes a post 61 having an externally threaded portion engaging an internally threaded member 63 mounted to housing 30. Other well known means for adjusting height may also be used. Post 64 bears against the surface of guitar body 12 in order to establish the height of the housing 30 with respect to guitar body 12 and, therefore, the spacing between coils 50–60 and strings 14. Post 64 is desirably mounted to housing 30 so that it may be placed between the two middle strings (D and G) of the guitar. To assist in alignment of the transducer assembly 16 during its attachment to the guitar 10, a line 32 may be provided in housing 30 to provide a visual indication of the location of post 64 which may be visually aligned with the space between the middle strings. To assist in rotation of post 61 to adjust the coil height, it may be provided with a thumbwheel 65.

For certain guitar bridge configurations, such as the Floyd Rose bridge, it may be necessary or desirable to provide an opening in the bottom of transducer assembly 16 to avoid mechanical interference with the bridge while permitting the coils to be positioned close to the strings. Other mechanical configurations may also be used to provide such mounting.

Mounting of the transducer coils 50–60 above strings 14 is preferred because of the variability among guitars in the spacing of strings 14 from guitar body 12. However, it would also be possible to dispose the coils 50–60 between strings 14 and guitar body 12, and such mounting may be preferable for a permanently mounted transducer assembly.

It will be understood that transducer assembly 20 may be provided with other means for adjusting the coil-spring spacing, such as means for adjusting the position of the coil assembly within housing 30.

In accordance with an important object of this invention, the operation of computer system 24 may be controlled from the vicinity of the instrument. To this end, transducer assembly 16 includes switch means for generating signals for controlling the operation of the computer. Also, the interface system includes means for detecting switch actuation and transmitting corresponding data to the computer system, more fully described later. As indicated, a switch block 28 comprising four switches 42, 44, 46, and 48 is provided. These switches are placed so that they may be easily accessed and operated by the interchanging information over communication channel 18 with interface system 20.

FIG. 4 is a schematic diagram showing the electrical operation of certain portions of transducer 16 and interface 20. As has been indicated, it is preferred that communication channel 18 comprise a standard cable assembly, and an 8-conductor telephone cable is particularly preferred because of availability. However, the use of an 8-conductor cable places constraints on the use of the conductors of the cable. One conductor 70 may be used as a common or ground line. In order to provide output information unambiguously for each of the strings of the guitar, six additional lines 74–84 may be used, each coupled to the active or non-grounded end of a different ferromagnetic coil. If the six coil output lines are dedicated to coil outputs, only one conductor is available for transmitting information regarding the switches 42–48 and, if transducer assembly 16 is to be provided with power from interface system 20, for transmitting such power. In order to provide switch closure information regarding multiple switches on one line, the system of the present invention incorporates a voltage switching scheme. Interface system 20 comprises a source of voltage V. This voltage source is coupled to conductor 72 through a resistor 86. One terminal of each of switches 42–48 is coupled to the common or ground potential on conductor 70. The other terminal of each of switches 42–48 is coupled to conductor 72 through one of the resistors 88–94, respectively. Resistors 88–94 are chosen to have different values. When no switch is closed, the voltage $V_O$ of conductor 72 equals V, and this of switches 42–48 is coupled to the common or ground potential on conductor 70. The other terminal of each of switches 42–48 is coupled to conductor 72 through one of the resistors 88–94, respectively. Resistors 88–94 are chosen to have different values. When no switch is closed, the voltage $V_O$ of conductor 72 equals V, and this condition may be detected by an A/D converter in the interface unit 20. However, whenever a switch is actuated, the corresponding resistor is coupled into the circuit and forms a voltage divider with resistor 86, rendering $V_O$ different than the open circuit voltage V. By monitoring voltage $V_O$, a switch closure on the switch block may be detected. Moreover, by selecting different values for each of resistors 88–94, the voltage $V_O$ may be made to unambiguously represent the switch closure condition of the switch block. It will be understood that a similar scheme may be utilized with more or less than four switches. It will also be understood that, by appropriate selection of the values of resistors 88–94, simultaneous closures of a plurality of switches may function as detectable signals, and the output voltage $V_O$ may be made to unambiguously indicate which combination of switches has been closed. By detection in interface unit 20 of the voltage $V_O$ representing switch closures in transducer 16, interface unit 20 may generate appropriate control signals for transmission to computer system 24, enabling control of the computer system from switches at the guitar.

It will be understood that switches 42–48 may generate detectable control signals of other types or in other ways. For instance, the resistors may be configured differently, or other voltage or current signal generating means may be used, or D.C. signals may be coupled to coil output lines, or A.C. signals may be coupled to output lines.

Transducer assembly 16 may desirably include amplification for signals generated by the coils. For instance, while the strings of an electric guitar typically produce a signal large enough to be transmitted without amplification to the interface system, steel string acoustic guitars, and particularly nylon string acoustic guitars treated in accordance with the method of the present invention, may require amplification to achieve signal level similar to those of an electric guitar. The preferred embodiment of transducer assembly 16 therefore includes six amplifier circuits, one for each of the coils 50–60, one such circuit being shown in FIG. 4. The circuit includes an amplifier 67, which may be a type LM324 amplifier, which is connected as an inverting amplifier. A regulator 95 such as a type LM 78L05 may be coupled to line 72 to provide a regulated output supply. Use of such a regulator requires that the voltage supplied from interface system 20 be maintained above a certain minimum to permit operation of the regulator. Amplifier 67 may be powered from the regulated supply or directly from conductor 72. DC bias is supplied to the positive input of amplifier 67 by a divider network consisting of resistors 87 and 99. One of the coils 50–60 is coupled to the negative input of amplifier 67 through coupling capacitor 71 and input resistor 73. The gain of the amplifier may be selected by positioning switch 105 to couple in one of the feedback resistors 101, 103, or 85. These feedback resistors may desirably establish gains of, for instance, one, ten, and one hundred for use with electric guitars, steel string acoustic guitars, and nylon string acoustic guitars, respectively. The gain of the amplifier circuit may also be made continuously adjustable, or adjustable under control of signals transmitted to transducer assembly 16 from interface system 20. The output 69 from each of the six amplifiers circuits coupled to coils 50–60 is coupled to one of the six separate conductors 74–84 of the communication channel coupling transducer 16 and interface system 20.

Figure 5:
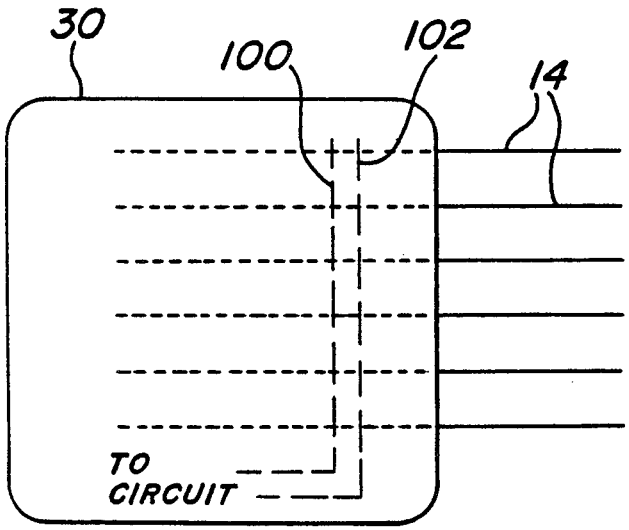
FIG. 5 shows apparatus for aiding in properly positioning the transducer with respect to the strings of an instrument.

FIG. 4 also shows an additional switch 98 in series with LED 96 and resistor 93 coupled between common conductor 70 and the regulated supply. Switch 98 and LED 96 provide a convenient means for optimally setting the height of the ferromagnetic coils with respect to the strings, as shown more clearly in FIGS. 3 and 5. As shown in FIG. 5, a pair of wires 100,102 may be disposed so as to be capable of being bridged by one or more of the strings 14. As shown, wires 100,102 are disposed perpendicularly to and parallel to the plane of guitar strings 14, and as shown in FIG. 3, parallel to and spaced from ferromagnetic coils 50–60. Wires 100 and 102 form normally open switch 98 as shown in FIG. 4. This structure may be used to aid in optimally set the height of the transducer assembly 16 as follows.

When transducer assembly 16 is initially placed on guitar 10, the wires 100,102 may be assumed not to be in contact with any of the strings 14. The height of adjustable post 64 may then be adjusted so as to move the ferromagnetic coils toward the strings 14. When wires 100,102 reach a predetermined height so as to contact any of the strings 14, assuming the strings 14 are conductive, the switch 98 will be closed and current flows through LED 96 to illuminate it. Accordingly, the illumination of LED 96 serves as an indication that wires 100,102 are in contact with strings 14. The height of transducer assembly 16 may then be raised by a predetermined amount by any convenient means, such as effecting a predetermined number of turns of a screw-mounted adjustable post 64. The predetermined coil-string distance should be set so that the coils are as close as possible to the strings without the possibility of the strings contacting the coils during vigorous playing. It should be noted that if the coil height is set too close to the strings, string contact with wires 100, 102 during playing will cause illumination of LED 96 to indicate the error condition. Also, closure of switch 98 creates a change in voltage $V_O$ due to the current supplied to LED 96, and this voltage condition may be detected by interface system 20 to generate a data signal representing string contact.

Setting the coil-string spacing may also be accomplished in an interactive process under control of software in computer system 24. Computer system 24 may receive data from interface system 20 based on the strength of the signals output by the transducer assembly 16, and may display information such as an image of coils and strings to assist the user in adjusting the spacing.

As has been previously described, it is desirable for the present invention to be usable with any ordinary commercially available guitar, whether electric or acoustic, and regardless of the type of strings used on the guitar. Many guitars employ steel strings, whose movements may be directly detected by the ferromagnetic coils to generate a voltage output signal related to the movement of the strings. However, other types of guitar strings, particularly nylon strings, are not ferromagnetic and thus their movement will not be detected by a ferromagnetic coil. Applicant has discovered that such guitar strings may be provided with ferromagnetic properties so that they may be detected by typical ferromagnetic pickup coils.

FIG. 6 shows a cross-sectional view of one of the strings 14 of the guitar, which may be assumed to be a nylon or other non-ferromagnetic material. Applicant has discovered that ferromagnetic material 104 may be affixed to the string to render its movement detectable by a ferromagnetic coil. Such ferromagnetic material 104 need only be applied to the string locally, in the vicinity of the ferromagnetic coil. In the preferred embodiment, the ferromagnetic material is applied to the string by painting the string with a fluid containing ferromagnetic material. One such material which has been found suitable for use in this application is a substance commercially available under the designation "nickel print", which comprises a suspension of nickel particles in a solvent and is used for such applications as repairing printed circuit traces. By painting nylon strings in a vicinity of the ferromagnetic coils with a material such as nickel print, upon evaporation of the solvent a ferromagnetic nickel residue adheres to the strings, rendering their movement detectable by ferromagnetic coils. Preliminary tests by applicant, both aural and waveform analysis, suggest that the application of such ferromagnetic material to a nylon guitar string does not substantially affect its acoustic properties.

Application of ferromagnetic material to the strings may also render them locally conductive, so that the previously-described string contact detection system may be used with nylon or other non-conductive strings.

It is believed that other means may be employed for rendering strings such as nylon strings ferromagnetic in the region of the coils. For instance, material 104 may comprise a foil of ferromagnetic material which is wrapped around and adhered to the strings, or it may comprise a ferromagnetic wire which is helically wound around the string. It may even be possible to introduce ferromagnetic material into the bulk of the string, such as by ion implantation.

The outputs of the ferromagnetic coils are low-level analog signals, generally voltage signals whose amplitude and frequency is related to the amplitude and frequency of movement of the adjacent string. Such signals are not well suited for direct input to a computer system. Accordingly, interface system 20 is provided in order to generate computer-compatible data signals representing pertinent information relating to the playing of the guitar.

Figure 7:
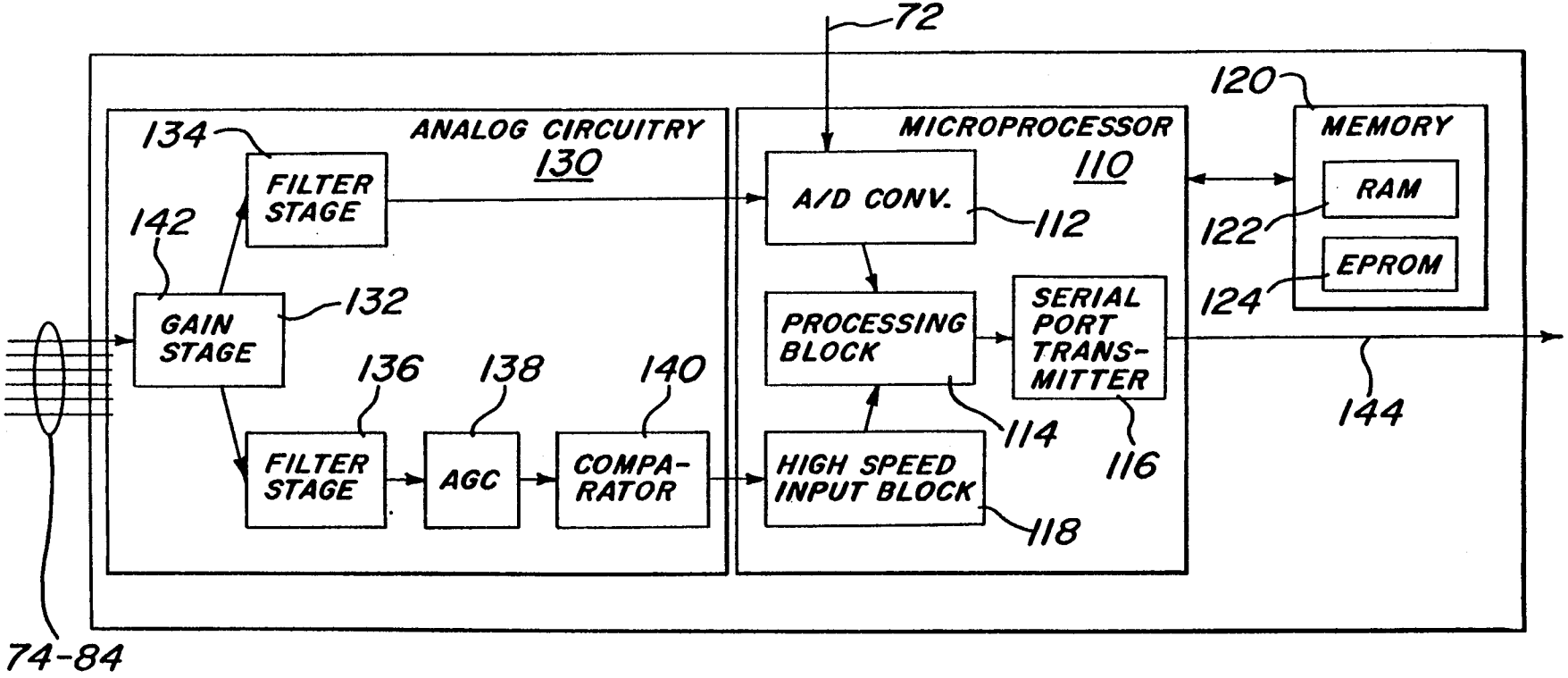
FIG. 7 is a block diagram of a preferred embodiment of the interface system of the present invention.

FIG. 7 is a block diagram of the circuitry of the preferred embodiment of interface system 20. Interface system 20 functions as a signal processor which comprises an analog section 130 coupled at input 142 to communication channel 18, to receive low level analog signals from transducer assembly 16. The outputs of the analog circuitry 130 are coupled to a microprocessor 110, which generates digital signals at a data output 144 suitable for coupling to a computer system 24. Microprocessor system 110 is coupled to a memory 120 including EPROM 124 for storage of operating programs and RAM 122 for storage of results of computations. Alternatively, of course, programs could be downloaded from computer system 24 into RAM 122, and EPROM 124 could be omitted.

One of the difficulties which has been encountered in interfacing an instrument such as a guitar with a computer involves limitations in extracting information from the analog signal generated by the instrument's transducer. Whereas with a keyboard instrument the contact closure caused by depressing a key may be used to directly and immediately generate a digital signal which may be interpreted as a particular note, generating digital signals representing the playing of an ordinary guitar is far more difficult. Prior art systems have used sophisticated signal processing techniques such fast Fourier transforms in order to meet the real time requirements for the MIDI interface, but such systems are complex and expensive. Simpler techniques, such as calculating the frequency based on the waveform period, have not been used because the excessive time required to generate information regarding the lower notes in the guitar range is incompatible with MIDI real time requirements. Applicant has developed a novel system including a novel protocol for reliably and inexpensively obtaining and transmitting the information needed for the interactive guitar instruction/practicing system of the present invention. The operation of this system is as follows.

Microprocessor 110 is desirably implemented using a type 80C196KB processing chip, because it includes an on board A/D converter, which is useful for processing amplitude information and, an on board high speed input block, which is useful for extracting frequency information. Thus, this chip may include A/D convertor 112, high speed input block 118 and processing block 114 of microprocessor 110. Serial port transmitter 116 may be implemented using a type AD 232 device.

Analog circuitry generally shown in block 130 is duplicated for each of the 6 active ferromagnetic coil outputs. Each section of analog circuitry has an input adapted to be coupled to one of the active coil output conductors 74–84 of communication channel 18. Input 142 is coupled to the input of an amplifier 132, or gain stage, which produces an amplified and low-impedance output signal suitable for further processing. Further processing takes place in two parallel paths. In one path, the output of amplifier 132 is coupled to the input of a filter 134. The output of filter 134 is coupled to the input of A/D converter 112 of microprocessor 110. The filtered signal provided by filter 134 provides detectable information which may be used to determine the envelope of the wave and the associated dynamics. In this way, processor 114 coupled to A/D convertor 112 may determine when the musician has started or stopped playing a string. Generally, the first signal path comprising filter 134 provides amplitude information regarding the playing of the instrument such as string strike events and power out events.

The second signal path includes filter 136, automatic gain control (AGC) block 138 and comparator 140, coupled in series . This second path is used to provide information regarding the frequency of movement to the string. The output of amplifier 132 is coupled to the input of filter 136 which operates to eliminate the bulk of the harmonic content of the input, leaving principally the fundamental frequency. The output of filter 136 is coupled to the input of AGC circuit 138, which applies automatic gain control and generates an output of substantially constant amplitude despite variations in the input amplitude. The output of AGC circuit 138 is coupled to the input of comparator 140. Comparator 140 provides an output square wave at the frequency of the fundamental frequency of the input wave received at input 142. The square wave output of comparator 140 is coupled to processor 114 via high speed input block 118. Inclusion of a high speed input block 118 in microprocessor 110 is highly desirable for quickly and accurately extracting frequency information from the output of comparator 140. The high speed input block stores the time of an event, such as the edge of an input wave, with the time resolution of the processor clock. This gives an extremely good resolution, e.g. 80 nanoseconds, without requiring interrupts which might create software bottlenecks.

By the two paths previously described, processor 114 receives amplitude information and frequency information relating to the movement of the guitar strings. Processing block 114 processes this information and transmits data representing the string movement via serial port transmitter 116 and communication channel 22 to computer system 24, as described more fully hereinafter.

It is believed that construction of appropriate analog circuit elements as shown in analog circuitry 130 is well within the ordinary skill in the art. While many circuits implementing the specified or equivalent functions may be employed, the preferred circuitry is shown in the schematic diagram of FIG. 8.

Figure 8:
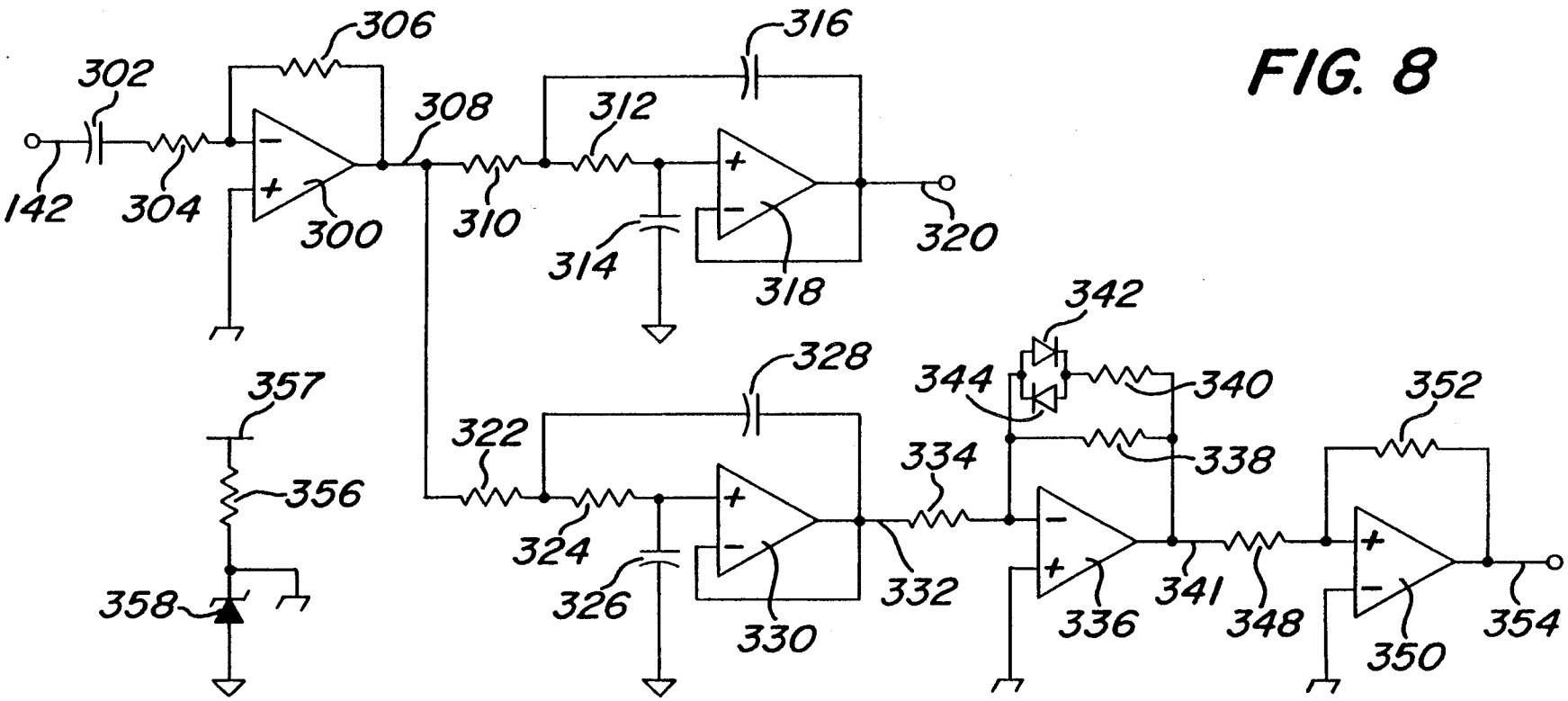
FIG. 8 is a more detailed schematic diagram of the analog circuitry of the interface system shown in FIG. 7.

FIG. 8 shows circuit blocks based on amplifiers 300, 318, 330, 336, and 350 which implement the functions shown in FIG. 7 as blocks 132, 134, 136, 138, and 140, respectively. These amplifiers may be type LM324 operational amplifiers. The amplifiers may desirably be operated from a single supply potential, and an intermediate common voltage for input biasing may be generated by resistor 356 and voltage regulator 358, although other equivalent biasing means may be employed.

Input 142, coupled to one of the coil output conductors 74–84, is coupled to an input of amplifier 300 through coupling capacitor 302 and input resistor 304. Feedback resistor 306 establishes the gain of the amplifier. The amplifier output 308 is coupled to the input of a two pole low pass active filter comprising amplifier 318, resistors 310 and 312, and capacitors 314 and 316. The output 320 of the filter is coupled to A/D convertor 112, for extraction of information regarding the amplitude of the fundamental frequency present.

Amplifier output 308 is also coupled to another similar two pole low pass active filter comprising amplifier 330, resistors 322 and 324, and capacitors 326 and 328. The active filter output 332 is coupled to an AGC amplifier based on amplifier 336. For low level signals up to a certain level, the amplifier provides a high gain established by input resistor 334 and feedback resistor 338. Once the input and output signals exceed a certain level, diodes 342 and 344 become conductive, which couples in feedback resistor 340 to reduce the gain of the circuit. Thus, the circuit provides a substantially constant output level at output 341, for all signals present at input 332 greater than a threshold amount, by providing dynamically variable gain. Output 341 of the AGC amplifier is coupled to the input of a high gain amplifier comprising amplifier 350 and resistors 348 and 352 functioning as a comparator to provide high amplitude square wave output signals at 354, having the frequency of the fundamental frequency of the signal at input 142, for input to high speed input block 118.

It will be understood that while the analog circuitry for six coil inputs may have an identical structure to that shown in FIG. 8, component values desirably will be different in each of the six circuits, to establish different gains and filter cutoff frequencies appropriate for each of the six strings.

Operation of microprocessor 130 to perform the functions described herein is controlled by a program stored in EPROM 124. Operation of the microprocessor 110 may be in one of a plurality of modes selected by signals transmitted from computer 24 via communication channel 22.

Figure 9:
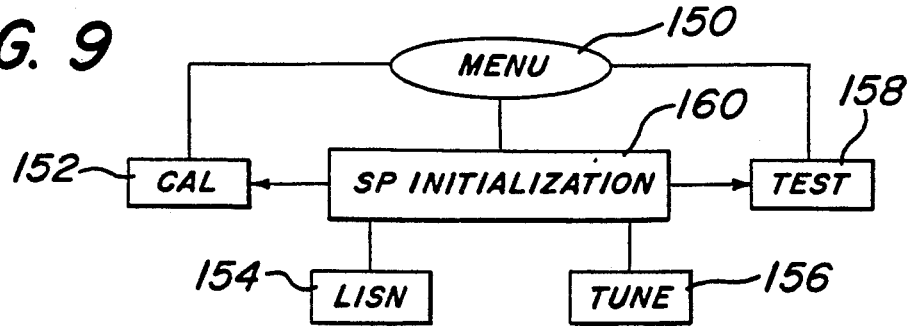
FIG. 9 is a schematic diagram generally illustrating the operation of the interface system of the present invention.

FIG. 9 illustrates the principal features of the software controlling operation of the interface system. The system of the preferred embodiment has three principal modes of operation which are accessed via a main menu. These modes are the calibrate mode 152 ("CAL"), the tune mode 156 ("TUNE"), and the listen mode 154 ("LISN"), which are entered after serial port initialization in block 160.

In the calibrate mode, the interface system calibrates itself to the guitar to which it is coupled. Calibration is performed in the calibrate mode with respect to two variables, amplitude calibration and frequency calibration. Amplitude calibration is performed in order to set threshold input signal amplitudes which when crossed are interpreted as playing events such as "strikes" and "power outs". In amplitude calibration, a string or strings to be calibrated is struck, and the maximum signal amplitude produced is determined in processing block 114 on the basis of information received from A/D converter 112. The strike threshold level $T_H$ for a particular string is computed in block 114 to be between the maximum amplitude thus detected and a noise threshold amplitude, for instance 60% of the maximum amplitude, and is stored in memory 120. A lower threshold $T_L$ indicative of "power out" is also computed in block 114 and stored in memory 120, for instance 10% of the maximum amplitude, and when the signal level falls below the power out threshold, that condition is considered a termination of the note being played. Amplitude calibration is performed at the time a calibrating strike is made. By performing such amplitude calibration, the interface system of the present invention can establish appropriate signal amplitude thresholds to account for variations in guitars, the positioning of the ferromagnetic coils with respect to guitar strings, and like variables. Such amplitude calibration may be done interactively by user prompts generated by computer system 24.

Desirably, an intermediate threshold is also established to account for conditions often encountered in guitar playing. A second note may be struck on a given string before the amplitude of the first note has fallen below the power out threshold. If falling below the power out threshold is required to reset the strike detection function and enable detection of a subsequent strike, then such second notes may fail to be detected. Accordingly, in the interface system of the present invention, desirably a third threshold level $T_M$ is established intermediate in amplitude between the strike threshold and power out threshold. An input signal falling below the intermediate threshold resets the strike detection function so that subsequent excursions of the signal level above the strike threshold will be detected as further strikes. Even more desirably, the intermediate threshold is dynamically updated automatically and repeatedly on a continuing basis in accordance with the signal amplitude in a time interval preceding each update, such as the amplitude of the most recent strike or strikes. For instance, the intermediate threshold $T_M$ may be set at 40% of the amplitude of the most recent strike(s). In this way the interface system may detect strikes which rapidly occur before preceding strikes have died away, regardless of changes in note amplitude which may occur during the playing of a song.

Figure 11:
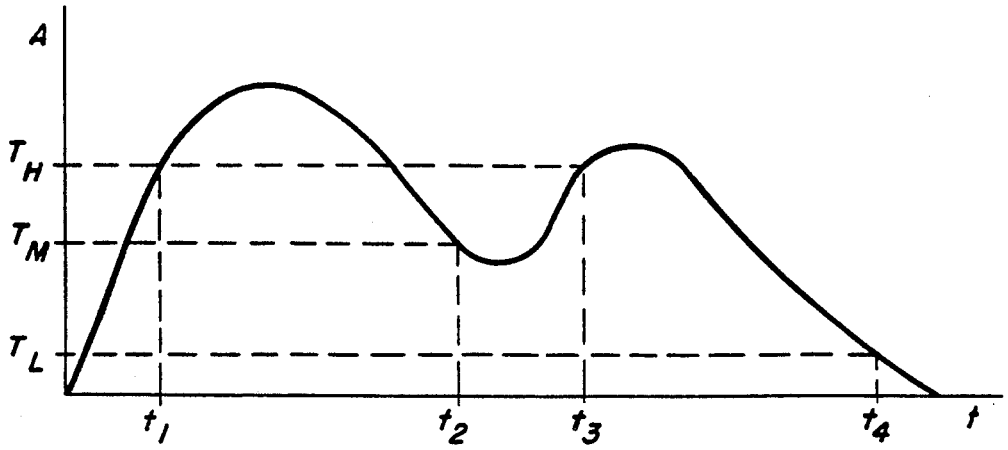
FIG. 11 illustrates amplitude calibration and strike detection in accordance with the present invention.

FIG. 11 is a graph of amplitude versus time showing the amplitude calibration and strike detection of the present invention. The curve indicated represents the amplitude characteristics of two notes struck in quick succession on the same string. The amplitude exceeds strike threshold $T_H$ at time $t_1$ which causes transmission of data representing the strike of the first note. At time $t_2$ when the amplitude falls below the intermediate threshold $T_M$, the function of transmitting strike information upon exceeded $T_H$ is reset. This occurs at time $t_3$ and data representing this second strike is transmitted. The amplitude falls below power out threshold $T_L$ at time $t_4$ and data representing a power out event is transmitted. Without the use of the intermediate threshold $T_M$, however, the second strike would not be detected since the strike function would not be reset until time $t_4$.

In frequency calibration, a string to be calibrated to is struck, and frequency of the open string is determined in processing block 114 in accordance with frequency data obtained through the second path of the analog circuitry. Data is stored representing the frequency of each open string, so that the initial tuning (or mistuning) of the guitar is established. Since for each string the frequency generated when it is played at a particular fret is established by the string's open frequency and the fret geometry, the frequency calibration data permits the subsequent determination of which fret is being played on any string of the guitar. Calibration data comprising frequencies and corresponding frets for each string is desirably implemented as a look-up table computed by processing block 114 on the basis of the open string frequencies and stored in memory 120. Stored frequency data may be compared by processing block 114 with frequency data responsive to transducer assembly 16 to generate and transmit data representing the strings and frets of the guitar which are being played.

In the TUNE mode of operation (block 156), interface system 20 repeatedly transmits data to computer system 24 over communication channel 22 representing the instantaneous frequency of the string being played. In this way, the computer 24 may display data representing the correctness of the tuning, such as an image of a tuning meter, to assist the guitarist in properly tuning the guitar.

It should be noted that the guitarist may cause the system to enter the calibrate or tune mode at any desired time by pressing the appropriate buttons on transducer assembly 16. Since the guitar tuning may change during a playing session, whether accidently or on purpose, the guitarist may enter the calibrate mode at any time to recalibrate the interface system 20 to the present tuning. If at any time the guitarist wishes to correct the tuning, he may enter the tune mode to assist in tuning the guitar as desired.

As has been previously noted, an important advantage of the present invention over the MIDI system is that the computer system and the interface system are designed to work together in the context of inputs from real guitars, and the novel communication protocol of the present invention avoids the limitations of the MIDI protocol which render it undesirable for use with guitars. The protocol of the present invention does not require transmission of frequency data simultaneous with strike information; rather, the occurrence of an event causes immediate transmission of data indicating that an event has occurred and data identifying the event, such as a time stamp. Information relating to the event, such a frequency data, may be transmitted later with identification data permitting the later data to be associated with the previously transmitted event data.

Table 1 below sets forth the preferred embodiment of the protocol of the present invention.

TABLE 1

| SERIAL PROTOCOL: | | | |
|---|---|---|---|
| Header Bits: | | | |
| 7: | Message Number | | |
| 6-0 | Message: 0 | | |
| | Packet: String # | | |
| Packets | | | |
| STRIKE | Message#/Header | [@000\|0001] | $01 |
| | String# | [----\|-***] | |
| | TYMIN 1 | [-***\|****] | |
| | TYMIN h | [--**\|****] | |
| FRET | Message#/Header | [@000\|0010) | $02 |
| | Fret#/String# | [****\|****] | |
| | TYMIN 1 | [-***\|****] | |
| | TYMIN h | [--**\|****] | |
| PWOUT | Message#/Header | [@000\|0011] | $03 |
| | String# | [----\|-***] | |
| | TYMIN 1 | [-***\|****] | |
| | TYMIN h | [--**\|****] | |
| TSTRK | Message#/Header | [@000\|0100] | $04 |
| | String# | [----\|-***] | |
| | TYMIN 1 | [-***\|****] | |
| | TYMIN h | [--**\|****] | |
| TFREQ | Message#/Header | [@000\|0101] | $05 |
| | FREQ 1 | [****\|****] | |
| | FREQ h | [****\|****] | |
| TPOUT | Message#/Header | [@000\|0110] | $06 |
| | TYMIN 1 | [-***\|****] | |
| | TYMIN h | [--**\|****] | |
| BUTT | Message#/Header | [@000\|0111] | $07 |
| | Button | [0000\|****] | |
| | TYMIN 1 | [-***\|****] | |
| | TYMIN h | [--**\|****] | |
| Messages Out (Interface > Computer) | | | |
| MENU | Header | [1100\|0010] | $C0 |
| LISN | Header | [1100\|0001] | $C1 |
| TUNE | Header | [1100\|0010] | $C2 |
| CAL | Header | [1100\|0011] | $C3 |
| TEST | Header | [1100\|0100] | $C4 |
| NMIN | Header | [1100\|0000] | $F0 |
| ERROR | Header | [1111\|1111) | $FF |
| Messages In (Computer > Interface) | | | |
| MENU | Header | [1100\|0010] | $C0 |
| LISN | Header | [1100\|0001] | $C1 |
| TUNE | Header | [1100\|0010] | $C2 |
| CAL | Header | [1100\|0011] | $C3 |
| TEST | Header | [1100\|0100] | $C4 |
| VAL | Header | [1100\|0101] | $C5 |

TABLE 1-continued

| SERIAL PROTOCOL: | | | |
|---|---|---|---|
| INV | Header | [1100\|1100] | $CC |

Glossary
- unused
* used
0 constant 0
1 constant 1
@ 0 or 1

The above table showed data packets which may be transmitted between the interface system 20 and the computer system 24. All data packets include message #/Header bytes. A STRIKE packet includes data representing the string on which the strike occurred (string #) and time stamp data identifying the event by the time at which the strike occurred (low and high TYMIN bytes). Such data may be generated by a clock provided in microprocessor 110. A FRET packet includes frequency data including the string number which was struck and the fret number (fret #) being played on that string, as well as time stamp data. The power out packet PWOUT includes string number data and time data relating to the time of the power out event on that string. Packets sent in the tuning mode include a tuning strike packet TSTRK, containing string and time data when a string is struck during tuning; tuning frequency packet TFREQ, containing frequency data for the string which was struck; and a tuning power out TPOUT packet indicating power out of a string which was struck during tuning. Finally, a packet BUTT identifying the pressing of a button includes data representing which button was pressed and the time which it was pressed.

Messages which may be exchanged between the interface system and the computer system include MENU, LISN, TUNE, and TEST messages to coordinate the operation of these components in those modes. The interface system may also send an NMIN message indicating that a new minute has occurred on its internal clock, and an ERROR message upon the occurrence of an error condition. The computer system may send VAL and INV messages to indicate that packets received from the interface system are valid or invalid.

The primary mode of operation of interface system 20 is the listen or LISN mode set forth in block 154. Operation of the system in the listen mode is detailed in the flow chart of FIG. 10, which also shows several interrupt and auxiliary routines utilized in the listen as well as other modes.

The basic interface system architecture includes interrupt-driven routines, main level routines, and auxiliary routines. The interrupt routines include ADService routine 178, which determines the amplitude or signal strength of the signal being received from a string and its associated coil. By comparison with stored data representing amplitude thresholds, as previously described, the occurrence of a "strike" or "power out" event may be detected. The ServiceClock routine 180 comprises an on-board event clock. This clock is used to time stamp events as they occur, by associating data representing the time of an event with data representing the nature of an event. This permits, among other things, analysis of the temporal accuracy of the musician's playing. Desirably, this clock has resolution on the order of hundredths of a second.

Getpds routine 182 is a routine for determining the period, and therefore the frequency, of a string being played. As has been previously described, such information enables the determination of which fret is being played on a particular string.

Because of the use of the novel protocol of the present invention, relatively slow but reliable, inexpensive, and easily implemented methods may be used for frequency detection. For instance, the period of the input signal to the high speed input block may be counted in clock cycles. To insure accurate detection, a predetermined number of periods may be required to occur sequentially with period times within a predetermined tolerance in order to consider the frequency data valid. For instance, the processor may wait until four substantially identical periods have been received in a row to provide transmittable frequency data. While the delays caused by such a frequency detection scheme are generally not objectionable in the learning and practicing environment for which the present invention is intended, various techniques may be used to improve the speed of frequency data acquisition. For instance, the number of periods required to obtain valid data may vary from string to string. Also, programming techniques may be used to speed data acquisition upon the occurrence of frequently encountered conditions. For instance, although a string may be vibrating at a fundamental frequency, the frequency detected by a ferromagnetic coil may alternate between first and second harmonic as the direction of movement of string with respect to the coil changes. The processor may detect such alteration between first and second harmonic and determine the frequency without waiting for a predetermined number of identical periods.

CheckPalette routine 184 is a routine used to poll signals received from the control buttons 42–48 of transducer 16. This routine determines if any of the buttons have been pushed, and if so, identifies them.

Figure 10:
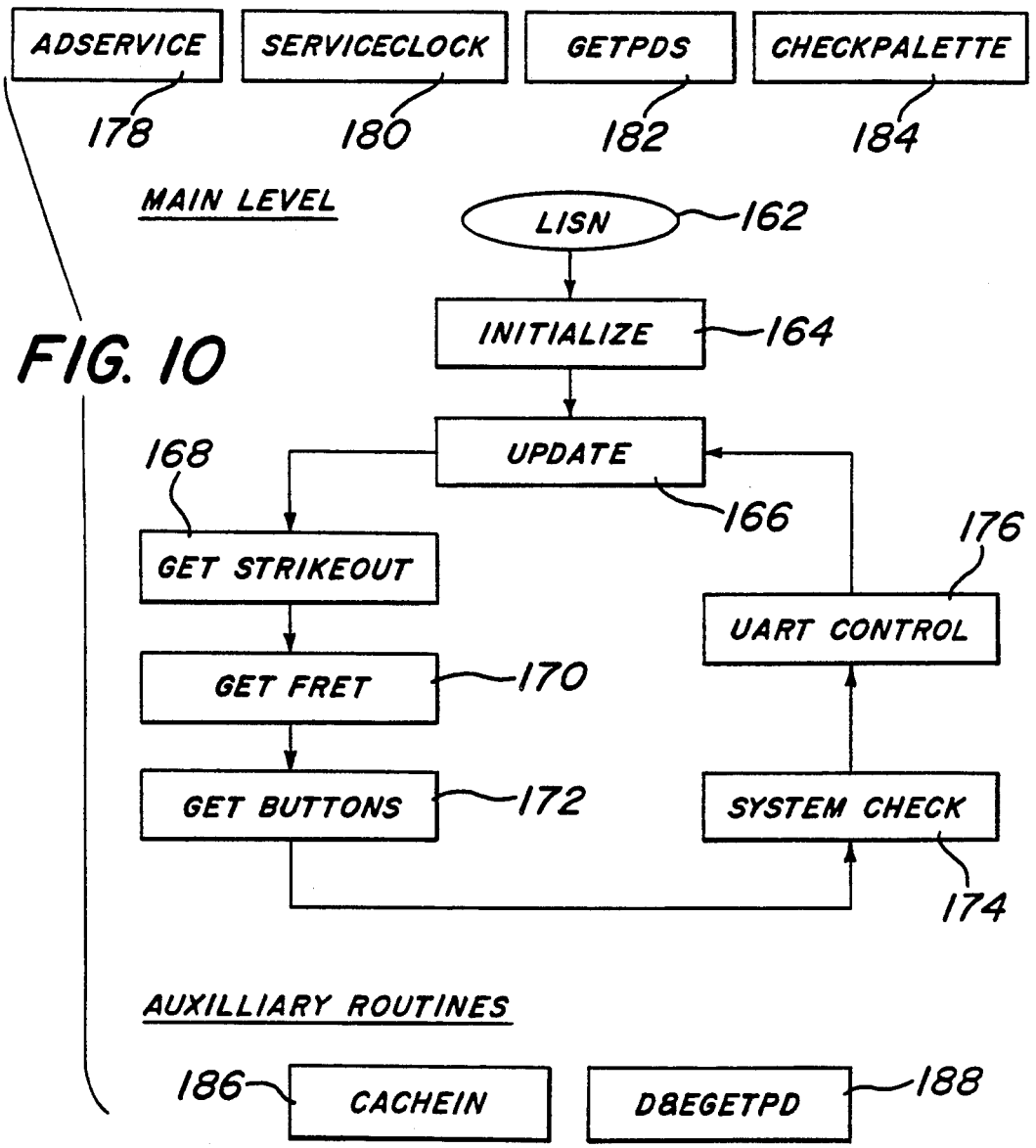
FIG. 10 is a more detailed schematic diagram illustrating certain aspects of the operation of the interface system of the present invention.

The main level flow chart in FIG. 10 illustrates the operation of the listen routine entered at step 162. In step 164, all variables are initialized. In step 166, the string number is updated to correspond to the guitar string being evaluated in the current loop, and steps 168–176 are performed for that string. In step 168, the signal strength is evaluated and compared with predetermined strike thresholds and power out thresholds, in accordance with ADService routine 178. A data packet representing a strike will be transmitted if the signal strength has exceeded the predetermined strike threshold, and a data packet indicating a power out will be transmitted if the signal strength has fallen below a predetermined threshold after a strike.

In step 170, the fret number being played is determined based upon the Getpds routine 182.

In GetButtons step 172, the routine checks to see if the CheckPalette routine has returned a switch closure indicating that a button has been pressed. If so, a data packet representing the pressing of a button will be transmitted.

System check step 174 performs an overall system check to determine whether everything is properly functioning. This check includes whether communication is still intact between interface system 16 and computer 24, and whether any of the memory has overflowed.

UART Control step 176 is responsible for all communication between interface system 16 and computer 24. In this step, all data packets representing conditions determined in the listen loop are transmitted to computer 24 in accordance with a predetermined data protocol. Cachein auxiliary routine 186 stores packets that are detected while passing through the loop into a memory cache for transmission during UART Control step 176. Another auxiliary routine, D&EGetpd, enables and disables the interrupts that are triggered by an input wave. This routine is provided to speed up processing of input signals. For instance, striking one string may directly or indirectly induce a signal in a coil adjacent a nearby string. This signal may be amplified sufficiently to be detected in the frequency determining branch of interface system circuitry, but it wastes time to determine this frequency when it does not represent a real playing event. Therefore, the period computation routine is disabled for a given string unless the amplitude detection means indicates that a strike has been made on that string.

By the foregoing method and apparatus, computer-processable data may be generated relating to the playing of a guitar or other string musical instrument. As described below, a computer receiving such data may provide a software-based interactive learning program for a musician, to improve the musician's skills and music knowledge.

Having been provided with the ability through transducer 16 and interface system 20 to receive data representing the playing of a guitar, computer 24 may be programmed to provide an intelligent and interactive system for teaching and improving the skills of a musician. The program of computer 24 desirably provides the musician with the ability to practice with the computer as the computer provides feedback to the musician; suggests exercises to the musician based on the specific skills which have been or ought to be learned; and presents context-sensitive music theory to the musician to effectively teach the musician in accordance with the musician's level of skill and previous learning. Such interactive teaching and practicing is primarily effected through generation of graphic or visual outputs and of audio outputs by computer 24.

Figure 12:
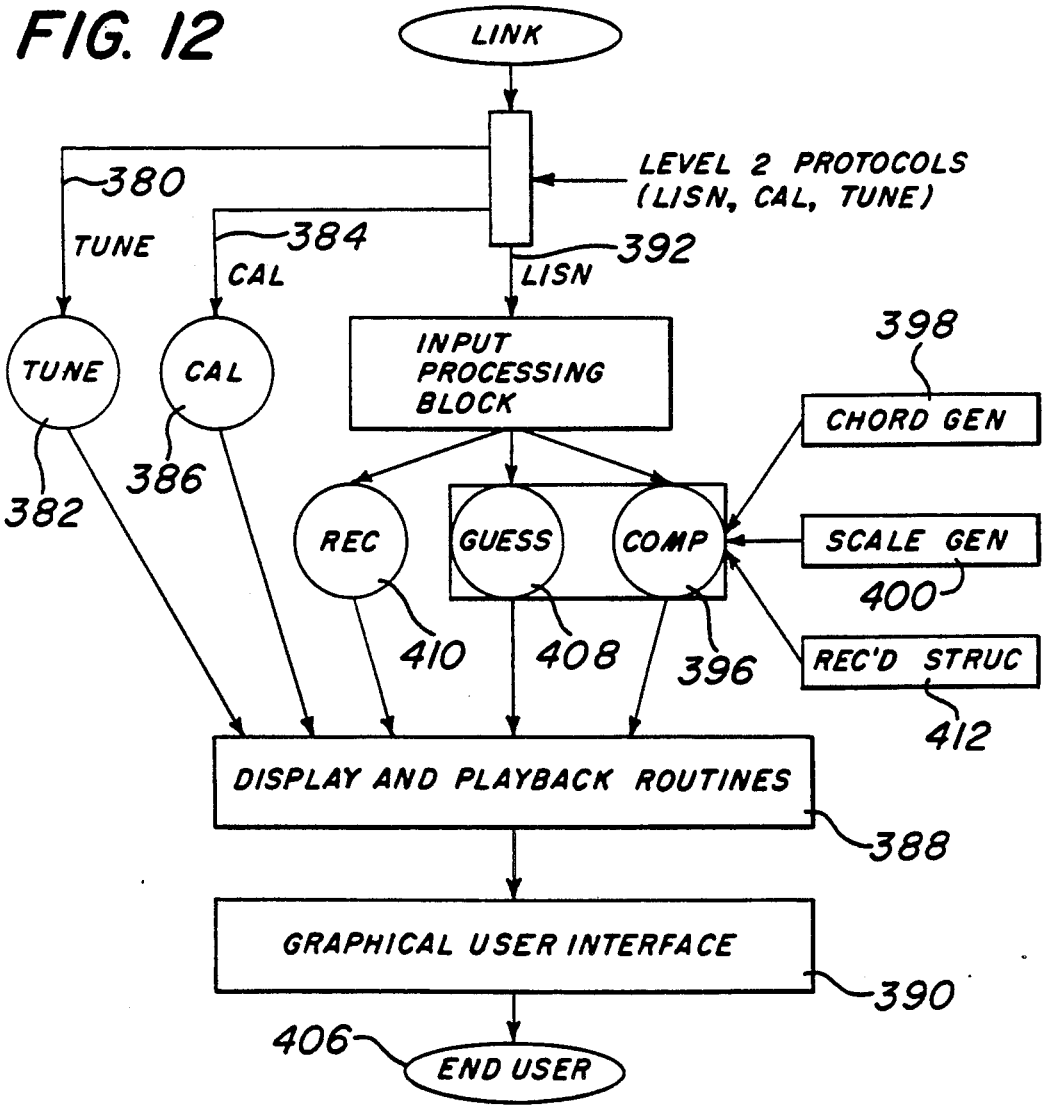
FIG. 12 is a schematic diagram illustrating communication between the interface system and the computer system of the present invention.

FIG. 12 is a schematic diagram illustrating the operation of the computer system 24 and the interface system 20 in accordance with the protocol of the present invention. The interface system 20 communicates with computer system 24 through one of three protocols: CAL, TUNE, and LISN. These may be layer two protocols available in the preferred Macintosh computer. These protocols carry data specific to the functions which the computer system is to perform in a current mode. For instance, in tuning mode 382, data transmitted in the TUNE protocol 380 would include frequency data which would be converted for display in block 388 and displayed to an end user 406 by a graphic user interface 390. In the calibrate mode 386, data transferred in the CAL protocol 384 would include data regarding calibration commencement, completion, and error. In the LISN mode, data transferred in the LISN protocol 392 includes string strikes, frets, and power outs. Computer system 24 may operate in three modes in accordance with LISN protocol. These are COMPARE mode 396, GUESS mode 408, and RECORD mode 410. In the COMPARE mode 396, input data from the guitar is compared with data created by a chord generator 398, data created by a scale generator 400, or a played structure 402 such as an exercise stored in memory or data representing music played by the user. Based on the results of the comparison, an output is generated in block 388 and displayed on graphic user interface 390. A GUESS mode 408 attempts to determine what the user intended to play when what was actually played does not correspond to stored data, such as an intended chord when a played chord does not correspond with known chords stored in memory. The COMPARE mode may be used to compare any two data structures representing musical information, such as any played structure and any library structure stored in memory which may include recorded structure 412 and structures generated by the chord and scale generators. In the RECORD mode, input data from the guitar is stored in memory, such as on a disk, either as it was input or after processing.

The COMPARE, GUESS and RECORD modes are used in the five main program areas, Discovery, Practice, Apply, Evaluate, and Perform, described below.

Figure 13:
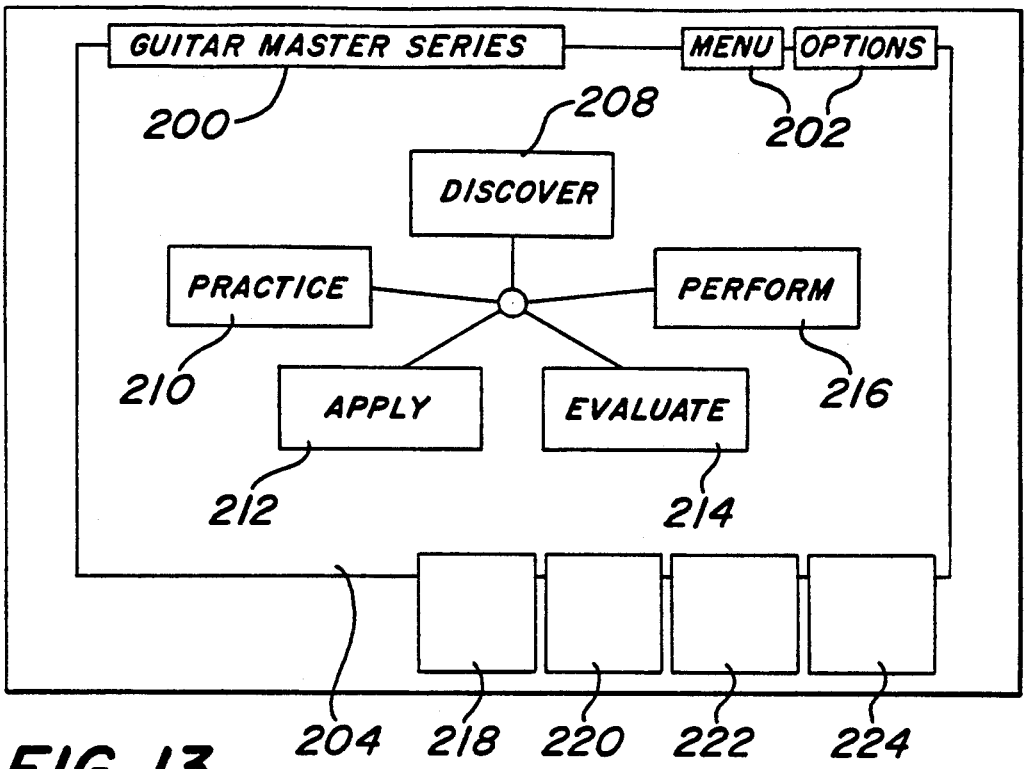

A representation of the graphic output of the computer to be displayed on display 26, such as a CRT, is shown in FIG. 13. This display contains a variety of types of information. As shown in FIG. 13, such information includes a text or other icon 200 identifying the active area of the program. It further includes a main display area 204 providing information to assist the musician in navigating or selecting available program options, a display of information relating to music which has been played by the musician, or a display of information comprising instructions to the musician as to music theory generally or specific exercises to be performed by the student. The graphic display also includes information regarding the buttons 42–48 of transducer 16. As shown, this information consists of a graphic representation 218–224 of the buttons 42–48, which may inform the musician by appropriate text information as to the function which will be performed by pressing the buttons. In this way, the functions performed by the buttons can be changed during program execution to suit the requirements of particular portions of the program, and by viewing the display 26 the musician is informed of the action which will be taken by pressing a particular button at that time. The musician can take such action from the transducer by pressing the appropriate button without the need to remove the hands from the guitar and go to a computer keyboard. Other means such as menus may be used to represent the action which will be taken by pressing the buttons.

The preferred embodiment of the software operating computer 24 comprises a modular architecture, with each program area designed to strengthen a specific skill of a musician using the system. In FIG. 10, five program areas of the preferred system are identified in the main display area 204. Each of the program areas 208–216 shown is supported by links into a music theory stack stored in memory. The music theory stack comprises a set of data which is used to analyze inputs and generate outputs pertinent to the practicing or instruction being performed.

Operation of the preferred programs areas 208–216 shown in FIG. 13 is illustrated by the graphic displays of FIGS. 14–19 which may be generated by such programs.

Figure 14:
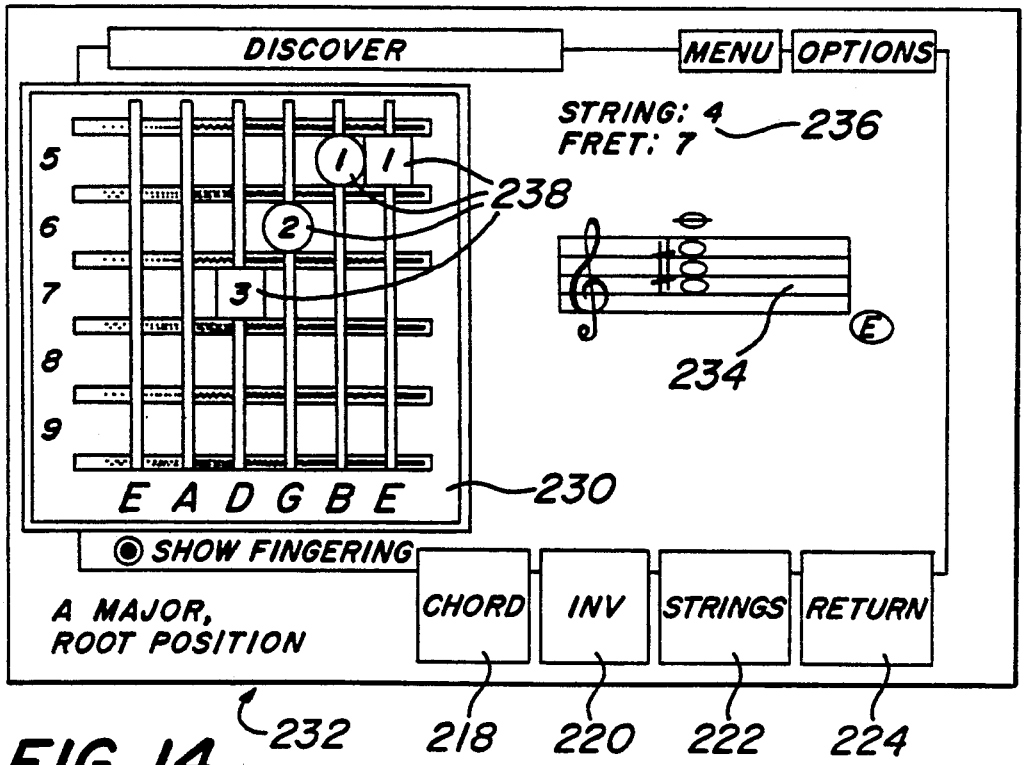
Figure 15:
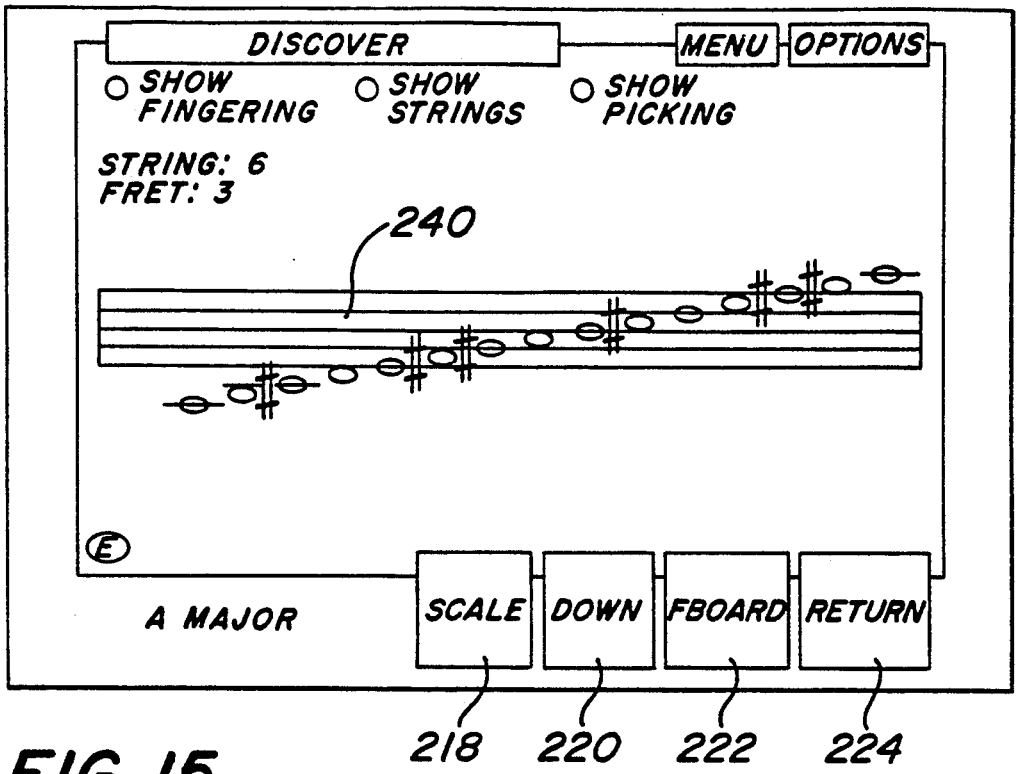
Figure 16:
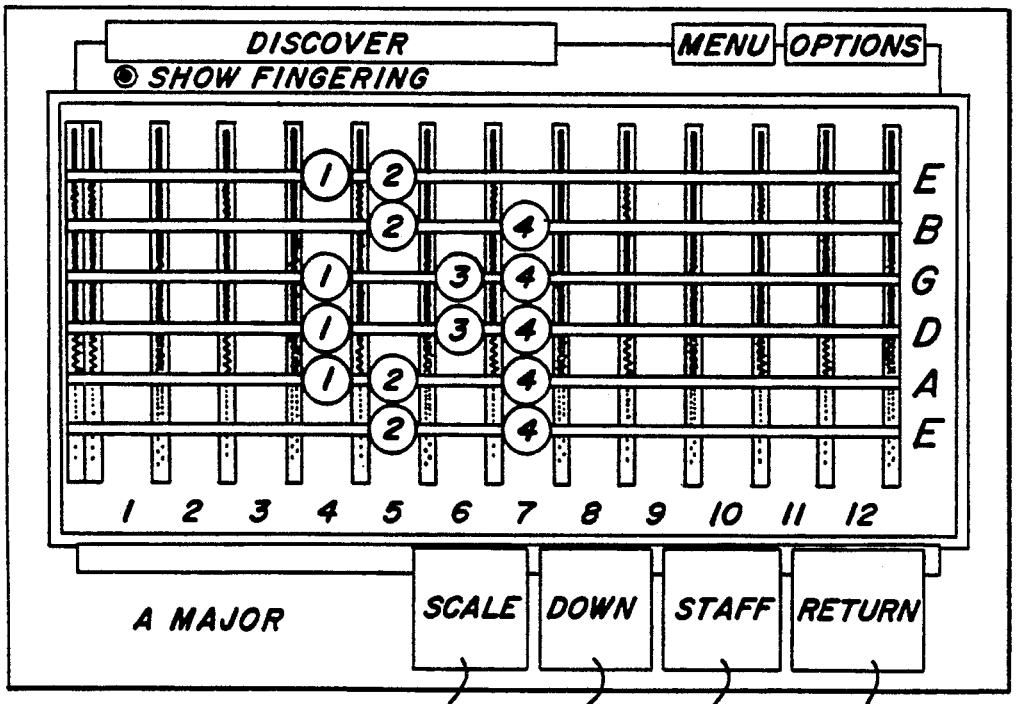

The discover module 208 produces output information relating to the basic foundations and building blocks of music, and relates them to the guitar. Such foundations and building blocks include notes, chords, scales, and arpeggios. By selecting the discovery area 208 in FIG. 13, a variety of outputs can be generated as illustrated in FIGS. 14–16 to assist in learning the foundations of music. FIG. 14 illustrates a display which may generated upon actuating the discover program area 208. Display area 200 shows that the discover program is active. The display area 204 contains information relating to a selected chord. This information includes an identification 232 of which chord is being played, as shown an A Major chord in the root position. The main display area 204 includes a graphic representation 230 of a guitar neck, showing fret numbers along the left side of the display and string identifications along the bottom of the display. The representation includes indicia 238 illustrating which fingers are to be placed on which strings at which frets in order to play the selected chord. The main display area also includes a representation 234 of a staff showing the notes comprising the selected chord. Also, indicia 236 indicate the root string and fret position for the selected chord.

By actuating button 220, the display is revised to show other inversions of the selected chord. Button 224 causes the system to return to the main menu illustrated in FIG. 13. If the musician plays a chord, data will be transmitted to computer 24 corresponding to the strings and frets played. The software can then evaluate the chord played, compare it with the selected chord, and display information indicating whether the chord was properly played.

If the scale icon 234 is selected, such as by clicking a mouse button, a display of the scale corresponding to the selected chord is generated, as shown in FIG. 15. This display includes a staff having the notes of the selected scale indicated thereon (240). By selecting the scale icon 240, an audio output is generated corresponding to the selected scale. Which scale is being displayed can be changed by actuating button 218. Actuating button 222 in the state shown in FIG. 15 causes generation of the fingerboard display shown in FIG. 16. This display comprises a graphic representation of the fingerboard of a guitar, with the fret numbers indicated at the bottom and the strings indicated at the right. At the appropriate strings and frets, indicia are provided to show the correct fingering used to play the selected scale. The selected scale may be altered by actuation of button 218, and display may be returned to that of FIG. 15 by actuating staff button 222.

Figure 17:
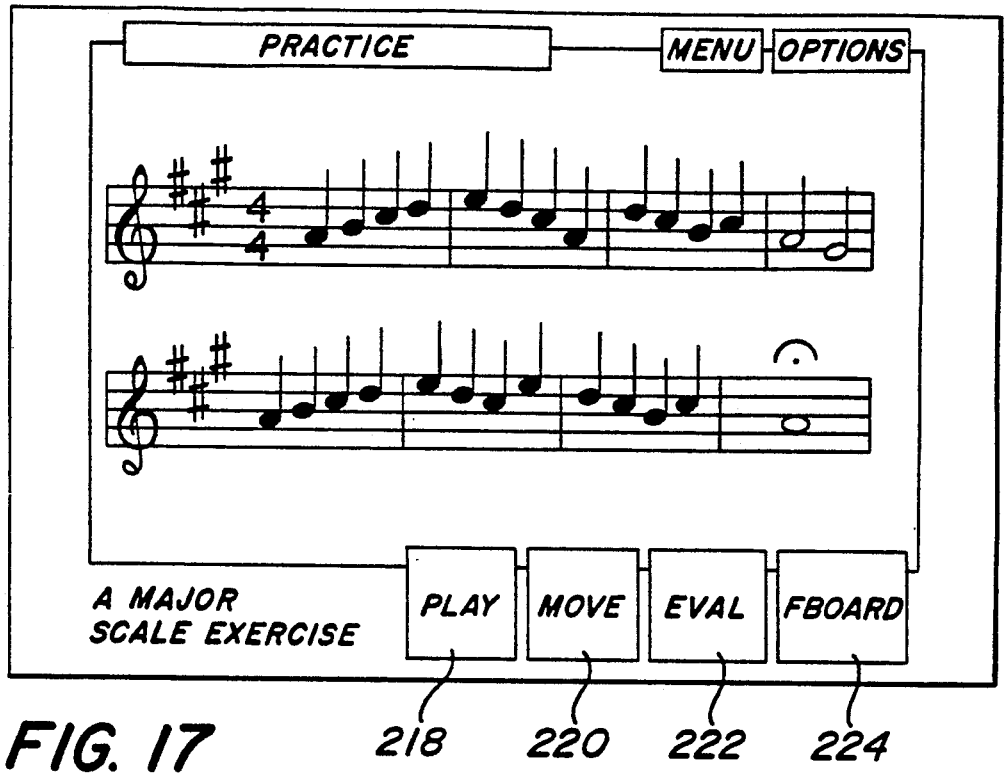
Figure 18:
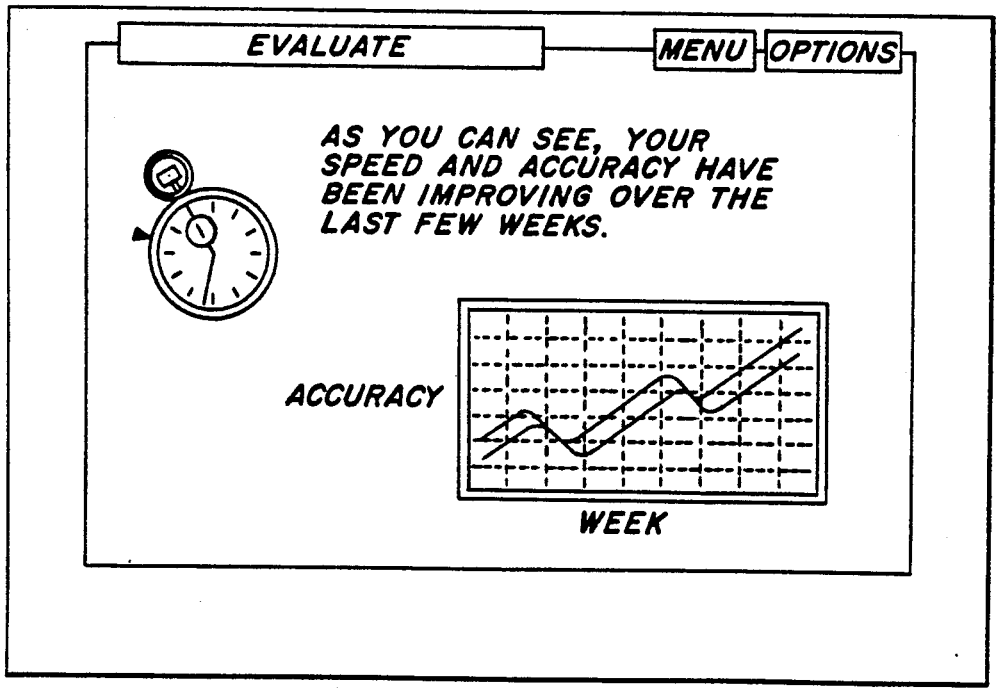

A display which may be generated by selecting the practice icon 210 in FIG. 13 to enter the practice program area is illustrated in FIG. 17. The practice area provides exercises designed to improve the musician's level of expertise in a particular skill or technique. Exercises may be selected in accordance with the progress and skill level of the musician, which may be modeled in the software. This model categorizes and classifies various areas of musical knowledge, and assigns an ability level to those classes based upon the performance of the musician. As shown in FIG. 17, in the practice program area the main area of the visual display includes a visual representation of the exercise to be played in the selected scale. By selecting button 218, the indicated music is played via the audio output of computer 24, so that the musician can hear the selected exercise. Actuation of button 222 causes an evaluation of the musician's playing by comparing it with the displayed exercise. If the musician is having difficulty with a particular part of the displayed exercise, button 220 may be actuated to move to a particular section of the music, so that it can be practiced. Actuation of button 224 will generate a visual display illustrating the keyboard and the fingerings appropriate for playing the specified exercise.

The apply program area, made active by selecting icon 212 in the main display of FIG. 13, is similar to the practice area previously described. However, in the apply program area, the guitarist is presented with real musical pieces as opposed to exercises, which may be selected from a variety of musical styles such as rock, jazz, classical. Upon selecting a piece, it is transposed to the appropriate key corresponding to the musician's previous discovery and practice, such as A Major in the examples given. Buttons representations 218–224 may be configured in the apply program area to operate as previously disclosed with respect to the practice program area, i.e. a play button to cause an audio output of the selected music, a move button to select a particular portion of the music, an evaluate button to compare the musician's playing with the selected music, and a fingerboard button to illustrate the guitar fingerboard and the appropriate fingering of the selected music.

The evaluate program area may be activated by selecting icon 214 in FIG. 13. This program evaluates the musician's progress in a specific area by testing the musician on the material covered to that point. A graphic display of the musician's speed and accuracy in playing the test selections may be generated, as illustrated in FIG. 16.

Figure 19:
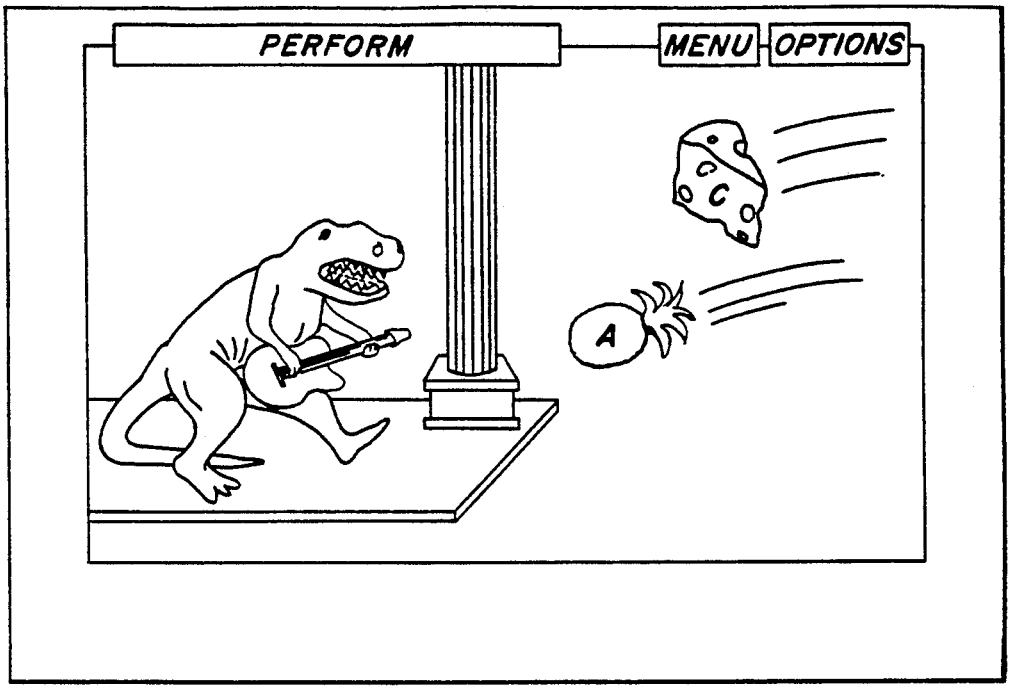
FIG. 13–19 illustrate graphic displays associated with operating of system of the present invention.

The perform program area is activated by selected icon 216 in FIG. 13. In the preferred embodiment, the perform program comprises a set of games which simulate a live performance by the musician. Such games provide an entertaining method to practice previously covered musical material. FIG. 19 illustrates the graphic display associated with one preferred game in accordance with the present invention. The display comprises a representation of a guitarist upon a stage. A set of objects, each of which displays indicia of a musical note, chord, scale, or the like, is represented as being thrown towards the musician on the stage. If the musician correctly plays the music associated with an object, it will vanish. Otherwise, the object will hit the representation of the guitarist.

In a second preferred game in the perform program area, the computer generates a sequence of notes by audio and/or graphic display. The musician is required to duplicate the sequence of notes generated played by the system. A progression of sequences is desirably generated, each of which is more difficult that the previous sequence. The game may be associated with graphic representations of hazards to be avoided by a player icon, which hazards are successfully avoided only if the musician correctly duplicates the sequences generated by the system.

It is believed that programming a computer system to operate with the described protocol in the described modes to produce the described outputs may be preferred by one skilled in the art without undue experimentation.

The preferred protocol and interface system described herein need not be used to supply music data to an interactive computer system operating as described herein. Such a computer system may, for instance, be used with an instrument providing a MIDI output, and will still provide the desirable interactive teaching and practicing functions described above.

By providing computer system 24 with removable non-volatile memory, memory media having different stored programs may be provided to the user for different teaching and practicing applications. For instance disks may be provided which have different exercises to be performed, music and information related to particular artists, songs, styles of playing, types of music, and the like. This enables the user to tailor the system to his skills and interests.

Accordingly, an electronic music system has been described which provides a computer-based interactive system for learning and for practicing a conventional stringed musical instrument such as a guitar. Variations on the disclosed system will no doubt occur to those skilled in the art without departing from the spirit and scope of the invention.

What is claimed is:

1. Interface apparatus for interfacing an analog electrical signal representing an acoustic signal to a digital computer comprising:

an interface input adapted to be coupled to a first communication channel to receive said analog electrical signal;

a processor coupled to said interface input for processing signals received at said interface input and for producing digital output signals at a processor output in response to received signals; and an interface output coupled to said processor output, said interface output being adapted to be coupled to a digital computer by a second transmission channel for interchanging digital signals, wherein said processor produces digital output signals in response to changes in said analog electrical signal, said digital output signals including event data representing the occurrence of a change in said analog electrical signal and identifying data uniquely identifying each such event.

2. Apparatus according to claim 1, wherein said processor compares the amplitude of said analog electrical signal with one or more stored threshold values, and said processor generates event data in response to such comparison.

3. Apparatus according to claim 2, wherein said event data includes data representing a strike event, which is generated when the amplitude of said analog electrical signal exceeds a stored strike threshold value.

4. Apparatus according to claim 2, wherein said event data includes data representing a power out event, which is generated when the amplitude of said analog electrical signals falls below a stored power out threshold value.

5. Apparatus according to claim 1, wherein said processor includes means for generating and storing data representing one or more threshold values as a function the amplitude of said analog electrical signal existing at a predetermined time.

6. Apparatus according to claim 5, wherein said predetermined time is the time at which said processor receives a calibration signal.

7. Apparatus according to claim 5, wherein said processor includes means for automatically and periodically updating one or more of said stored threshold values, and said predetermined time is a time interval immediately preceding each such updating.

8. Apparatus according to claim 1, wherein after transmission of event data representing the occurrence of a particular event, said processor produces further digital output signals including data relating to the analog electrical signal after the occurrence of said event and identifying data corresponding to said event.

9. Apparatus according to claim 5, wherein said data representing the analog electrical signal includes data relating to the fundamental frequency of said analog electrical signal.

10. Apparatus according to claim 9, wherein said apparatus is adapted for use with a guitar or other string musical instrument having frets, and said frequency related data includes data representing the fret generating an acoustic signal having the frequency of said analog electrical signal.

11. Apparatus according to claim 10, wherein said processor includes stored data representing the frequency generated by said strings played at said frets and means for comparing said stored fret frequency data with frequency data derived form said analog electrical signal.

12. Apparatus according to claim 11, wherein said processor includes means for computing sand storing said fret frequency data in response to a calibration signal.

13. Apparatus according to claim 1, wherein said processor includes a clock, and said identifying data includes the time at which an event occurred.

14. Apparatus according to claim 1, wherein said processor is operable in a plurality of modes, the mode of processor operation being determined by data received by said processor form said second communication channel.

15. Apparatus according to claim 14, wherein said modes includes a calibration mode, in which said processor computes and stored calibration data relating to said analog input signal.

16. Apparatus according to claim 15, wherein said calibration data includes amplitude calibration data computed as a function of the amplitude of said analog input signal.

17. Apparatus according to claim 15, wherein said calibration data includes frequency calibration data computed as a function of the frequency of said analog input signal.

18. Apparatus according to claim 14, wherein said modes includes a tuning mode in which said processor repeatedly produces digital output signals as a function of the frequency of said analog input signal.

19. Apparatus according to claim 14, wherein said modes include a listen mode in which, after the transmission of event data representing the occurrence of a particular event, said processor produces a further digital output signal including data relating to the frequency of the analog electrical signal and identifying data corresponding to said event.

20. Apparatus according to claim 1, wherein said interface input is adapted to receive predetermine control signals form said first communication channel and said processor produces digital output signals in response to receipt of said predetermined control signals.

21. Apparatus according to claim 1, wherein said processor includes amplifier means for amplifying said analog electrical signals.

22. Apparatus according to claim 1, wherein said processor includes a filter having an input coupled to said interface input and an output coupled to the input of an A/D converter, for generating at the output of said A/D converter a signal representing the amplitude of the fundamental frequency of the analog electrical signal present a the filter input.

23. Apparatus according to claim 1, wherein said processor includes a filter having an input coupled to said interface input, automatic gain control means, and a comparator, coupled in series, for generating at the output of said comparator a square wave signal having a substantially constant amplitude and a frequency corresponding to the fundamental frequency of the analog signal input to the filter 24. Apparatus according to claim 1, wherein said processor comprises a microprocessor system.

25. A method of providing digital signals for input to a computer which represent the playing of a musical instrument comprising the steps of:

converting acoustic signals caused by playing a musical instrument to analog electrical signals;

comparing the amplitude of said analog electrical signals with a first threshold value;

determining that a note-on event representing the commencement of a musical note has occurred when said analog electrical signal amplitude increases above said first threshold value; and providing a first digital signal which includes data representing that a note-on event has occurred and identifying data uniquely identifying that note-on event.

26. A method according to claim 25, wherein said identifying data is generated based upon the time at which said note-on event occurred.

27. A method according to claim 25, further including the step of determining the frequency of said analog electrical signal after the occurrence of said note-on event.

28. A method according to claim 27, further including the step of providing a second digital signal which includes data representing the musical note corresponding to said note-on event and derived from said determined frequency and identifying data identifying the note-on event to which said musical note data relates.

29. A method according to claim 28, wherein said musical instrument is a fretted string instrument, and said musical note data includes data identifying a string and a fret or the musical instrument.

30. A method according to claim 27, further including the steps of thereafter comparing the amplitude of said analog electrical signal with a second threshold value, determining that a note-off event representing the termination of a musical note has occurred when the amplitude of said analog electrical signal decreases below said second threshold value, and providing a third digital signal which includes data representing that a note-off event has occurred and identifying data identifying the note-on event to which said note-off event corresponds.

31. A method according to claim 25, further including the step of setting said first threshold value based upon the amplitude of said analog electrical signals occurring during playing the musical instrument.

32. Interface apparatus for interfacing an analog electrical signal representing an acoustic signal to a digital computer comprising:

an interface input adapted to be coupled to a first communication channel to receive said analog electrical signal;

a processor coupled to said interface input for processing signals received at said interface input and for producing digital messages at a processor output in response to received signals; and an interface output coupled to said processor output, said interface output being adapted to be coupled to a digital computer by a second communication channel for interchanging digital messages, wherein each of said messages produced by said processor includes an event-identifying message component which is selected from a set of predetermined event-identifying message components, each member of said set uniquely representing the existence of a predetermined response of said processor to said received signals, and a message-identifying message component which uniquely identifies that message and distinguishes it from all other message transmitted by said processor.

33. Apparatus according to claim 32, wherein said processor compares the amplitude of said analog electrical signal with one or more stored threshold values, and said processor generates event data in response to such comparison.

34. Apparatus according to claim 33, wherein said set of predetermined event-identifying message components includes a message component representing a strike event and said processor produces a message containing said strike event message component when the amplitude of said analog electrical signal exceeds a stored strike threshold value.

35. Apparatus according to claim 33, wherein said set of predetermined event-identifying message components includes a message component representing a power out event, and said processor produces a message containing said power out event message component when the amplitude of said analog electrical signals falls below a stored power out threshold value.

36. Apparatus according to claim 32, wherein said processor determines the fundamental frequency of said analog electrical signal, and said set of predetermined event-identifying message components includes a message component representing said fundamental frequency.

37. Apparatus according to claim 36, wherein said apparatus is adapted for use with a guitar or other string musical instrument having frets, and said fundamental frequency representing message component represents the fret generating an acoustic signal having the frequency of said analog electrical signal.

38. Apparatus according to claim 37, wherein said processor includes stored data representing the frequency generated by said strings played at said frets and means for comparing said stored fret frequency data with frequency data derived forms aid analog electrical signal.

39. Apparatus according to claim 38, wherein said processor includes means for computing and storing said fret frequency data in response to a calibration signal.

40. Apparatus according to claim 32, wherein said apparatus is adapted for use with a guitar or other string musical instrument having a plurality of strings, and said digital messages produced by said processor include a message component identifying the string producing the analog electrical signal to which the messages relate.

41. Apparatus according to claim 32, wherein said processor includes a clock, and said message-identifying message component includes the time at which the message is produced.

* * * * *